US008728699B2

(12) United States Patent
Iwata et al.

(10) Patent No.: US 8,728,699 B2
(45) Date of Patent: May 20, 2014

(54) POROUS FERRITE CORE MATERIAL FOR ELECTROPHOTOGRAPHIC DEVELOPER, RESIN-FILLED FERRITE CARRIER AND ELECTROPHOTOGRAPHIC DEVELOPER USING THE FERRITE CARRIER

(75) Inventors: Toru Iwata, Kashiwa (JP); Koji Aga, Kashiwa (JP)

(73) Assignee: Powedertech Co., Ltd., Chiba (JP)

( * ) Notice: Subject to any disclaimer, the term of this patent is extended or adjusted under 35 U.S.C. 154(b) by 535 days.

(21) Appl. No.: 12/907,246

(22) Filed: Oct. 19, 2010

(65) Prior Publication Data

US 2011/0129772 A1 Jun. 2, 2011

(30) Foreign Application Priority Data

Nov. 27, 2009 (JP) ..... 2009-270609

(51) Int. Cl.
*G03G 9/107* (2006.01)
*G03G 9/113* (2006.01)

(52) U.S. Cl.
USPC ..... 430/111.41; 430/111.4; 430/111.32; 430/111.33

(58) Field of Classification Search
USPC ..... 430/111.32, 111.33, 111.4, 111.41
See application file for complete search history.

(56) References Cited

U.S. PATENT DOCUMENTS

| | | | | |
|---|---|---|---|---|
| 5,643,704 | A * | 7/1997 | Tamura et al. | 430/111.3 |
| 2007/0141502 | A1* | 6/2007 | Aga et al. | 430/111.32 |
| 2009/0197194 | A1* | 8/2009 | Aga et al. | 430/111.34 |
| 2010/0055601 | A1* | 3/2010 | Sugiura et al. | 430/111.31 |
| 2010/0183970 | A1* | 7/2010 | Tsurumi et al. | 430/110.3 |
| 2010/0196818 | A1* | 8/2010 | Kojima et al. | 430/111.32 |

FOREIGN PATENT DOCUMENTS

| | | | |
|---|---|---|---|
| JP | 5-40367 | A | 2/1993 |
| JP | 2005-314176 | A | 11/2005 |
| JP | 2006-337579 | A | 12/2006 |
| JP | 2007-57943 | A | 3/2007 |
| JP | 2007-133100 | A | 5/2007 |
| JP | 2007-218955 | A | 8/2007 |
| JP | 2009-175666 | A | 8/2009 |

OTHER PUBLICATIONS

U.S. Appl. No. 12/962,833, filed Dec. 2010 by Iwata, T et al.

* cited by examiner

*Primary Examiner* — Jonathan Jelsma

(74) *Attorney, Agent, or Firm* — Greenblum & Bernstein, P.L.C.

(57) ABSTRACT

A porous ferrite core material for an electrophotographic developer, the porous ferrite core material including Mg in a content of 0.3 to 3% by weight, Ti in a content of 0.4 to 3% by weight and Fe in a content of 60 to 70% by weight, and the porous ferrite core material having a pore volume of 0.04 to 0.16 ml/g, a peak pore size of 0.4 to 1.6 μm, a saturation magnetization of 40 to 80 $Am^2/kg$, a remanent magnetization of less than 7 $Am^2/kg$ and a coercive force of less than 43 A/m; a resin-filled ferrite carrier for an electrophotographic developer obtained by filling a resin in the voids of the porous ferrite core material; and an electrophotographic developer using the ferrite carrier.

12 Claims, No Drawings

POROUS FERRITE CORE MATERIAL FOR ELECTROPHOTOGRAPHIC DEVELOPER, RESIN-FILLED FERRITE CARRIER AND ELECTROPHOTOGRAPHIC DEVELOPER USING THE FERRITE CARRIER

BACKGROUND OF THE INVENTION

1. Field of the Invention

The present invention relates to a porous ferrite core material for an electrophotographic developer, used in a two-component electrophotographic developer used in apparatuses such as copiers and printers, a resin-filled ferrite carrier and an electrophotographic developer using the ferrite carrier.

2. Description of the Related Art

An electrophotographic development method is a method in which development is conducted by adhering the toner particles in a developer to the electrostatic latent image formed on a photoreceptor, and the developer used in such a method is classified into a two-component developer composed of toner particles and carrier particles and a one-component developer using only toner particles.

As a development method using a two-component developer, among such developers, composed of toner particles and carrier particles, previously a method such as a cascade method has been adopted, but currently a magnetic brush method using a magnet roll predominates.

In a two-component developer, the carrier particles serve as a carrying substance to form a toner image on the photoreceptor in such a way that the carrier particles are stirred together with the toner particles in a developer box filled with the developer to impart an intended charge to the toner particles, and further, convey the thus charged toner particles to the surface of the photoreceptor to form the toner image on the photoreceptor. The carrier particles remaining on a development roll which holds a magnet again return from the development roll to the developer box to be mixed and stirred with the fresh toner particles and to be repeatedly used for a predetermined period of time.

In contrast to a one-component developer, a two-component developer is such that the carrier particles are mixed and stirred with the toner particles, thus charge the toner particles, and further have a function to convey the toner particles, and a two-component developer is excellent in the controllability in designing developers. Accordingly, two-component developers are suitable for full-color development apparatuses required to offer high image quality and for high speed printing apparatuses required to be satisfactory in the reliability and durability in image maintenance.

In two-component developers used in the above-described manner, the image properties such as the image density, fogging, white spot, gradation and resolution are each required to exhibit a predetermined value from the initial stage, further these properties are required to be invariant and to be stably maintained during the endurance printing. For the purpose of stably maintaining these properties, the properties of the carrier particles contained in the two-component developers are required to be stable.

As the carrier particles which form two-component developers, there have hitherto been used various carriers such as iron powder carriers, ferrite carriers, resin-coated ferrite carriers and magnetic powder-dispersed resin carriers.

Recently office networking has been promoted, and the age of monofunctional copiers develops into the age of multifunctional copiers; the service system has also shifted from the age of the system such that a contracted service man conducts periodic maintenance inclusive of the replacement of the developer to the age of the maintenance-free system; thus, the market has further enhanced demand for further longer operating life of the developer.

Under such circumstances, for the purpose of reducing the carrier particle weight and extending the developer operating life, Japanese Patent Laid-Open No. 5-40367 and the like have proposed a variety of magnetic powder-dispersed carriers in each of which magnetic fine particles are dispersed in a resin.

Such magnetic powder-dispersed carriers can be reduced in true density by decreasing the amounts of the magnetic fine particles and can be alleviated in stress caused by stirring, and hence can be prevented from the abrasion and exfoliation of the coating film and accordingly can offer stable image properties over a long period of time.

However, the magnetic powder-dispersed carrier is high in carrier resistance because the magnetic fine particles are covered with a binder resin. Consequently, the magnetic powder-dispersed carrier offers a problem that a sufficient image density is hardly obtained.

The magnetic powder-dispersed carrier is prepared by agglomerating magnetic fine particles with a binder resin, and hence offers, as the case may be, a problem that the magnetic fine particles are detached due to the stirring stress or the impact in the developing device or a problem that the carrier particles themselves are cracked probably because the magnetic powder-dispersed carriers are inferior in mechanical strength to the iron powder carriers and ferrite carriers having hitherto been used. The detached magnetic fine particles and the cracked carrier particles adhere to the photoreceptor to cause image defects as the case may be.

Additionally, although the magnetic powder-dispersed carriers can be produced by two methods, namely, a pulverizing method and a polymerizing method, the pulverizing method is poor in yield, and the polymerizing method involves complicated production steps, and hence both methods suffer from a problem that the production cost is high.

As a substitute for the magnetic powder-dispersed carrier, there has been proposed a large number of resin-filled carriers in which the voids in a porous carrier core material are filled with a resin. For example, Japanese Patent Laid-Open No. 2006-337579 proposes a resin-filled carrier prepared by filling a resin in a ferrite core material having a porosity of 10 to 60%, and Japanese Patent Laid-Open No. 2007-57943 proposes a resin-filled carrier having a three-dimensional laminated structure. These Japanese Patent Laid-Open Nos. 2006-337579 and 2007-57943 disclose that: various methods are usable as the method for filling a resin in a core material for a resin-filled carrier; examples of such a method include a dry method, a spray drying method based on a fluidized bed, a rotary drying method and a dip-and-dry method using a universal stirrer or the like; and these methods are appropriately selected according to the core material and the resin to be used.

Japanese Patent Laid-Open No. 2007-57943 also discloses that: it is preferable to reduce the pressure inside the filling apparatus when resin filling is conducted; it is difficult to fill the interior of the voids with a resin under normal pressure or under pressurized condition; the reduction of the pressure inside the apparatus enables to efficiently and sufficiently fill with a resin the voids inside the particles to facilitate the formation of the three-dimensional laminated structure.

Further, Japanese Patent Laid-Open No. 2007-133100 describes a carrier obtained by impregnating a resin into a porous magnetic material and a carrier obtained by coating the surface of a core material with a large amount of a resin. It is stated that the true specific gravities of these carriers are light, and hence by using these carriers in a refill developer for a two-component development method in which development is conducted while a refill developer having a toner and a carrier is being fed to a developing device, with a superfluous fraction of the carrier in the developing device being discharged, where necessary, from the developing device, the superfluous fraction of the carrier can be smoothly discharged together with the toner.

The porous magnetic powders described in these Japanese Patent Laid-Open Nos. 2006-337579, 2007-57943 and 2007-133100 include examples in which the pore volume of the core material is examined on the basis of the BET specific surface area or the oil absorption amount. However, the BET specific surface area is a surface area in itself, and the value thereof does not directly determine the actual porosity. Although the oil absorption amount reflects the pore volume to some extent, the oil absorption simultaneously measures the space between the particles as can be seen from the measurement principles thereof and hence does not lead to the actual pore volume. In general, the space between the particles is larger than the actual pore volume in the particles, and hence the oil absorption is insufficient in accuracy as an index for the purpose of filling a resin without extreme excess or deficiency. Additionally, these Japanese Patent Laid-Open Nos. 2006-337579, 2007-57943 and 2007-133100 do not include any description on the size of the pores located on the ferrite surface and filled with a resin and on the distribution of the pore size, and consequently, when a resin is actually filled, the filled resin amount varies among the particles or an insufficient uniformity of the filled resin is resulted. Consequently, the particles insufficiently filled with the resin are low in strength, and when the carrier is used in an actual machine, the cracking of the carrier particles occurs and fine particles are generated from the carrier particles to offer a cause for image defects.

Japanese Patent Laid-Open No. 2007-218955 describes the inclusion of $SiO_2$, $Al_2O_3$ and the like in manganese ferrite, and also describes the pore size, pore volume and the like of the particles of a core material. Specifically, Japanese Patent Laid-Open No. 2007-218955 discloses that: the provision of a carrier core material, at a stage of the carrier core material before the resin coating, with the durability enabling to maintain a high resistance under the conditions of high voltage application remarkably improves the maintenance of the high resistance at the time of the high voltage application when used as an electrophotographic developer, and enables to prevent the breakdown and the degradation of the image properties; additionally, with respect to the spent resistance, it is important to obtain a carrier core material by forming a porous magnetic powder having a specific pore distribution property and by subjecting the porous magnetic powder to a treatment for providing the powder with a high resistance.

However, in this Japanese Patent Laid-Open No. 2007-218955, a nonmagnetic component is required to be contained in a large amount to lead to a high probability of the occurrence of a low magnetization, and hence it is difficult to obtain a core material particle having an intended magnetization.

Japanese Patent Laid-Open No. 2005-314176 discloses a spherical ferrite particle containing Mg, Mn or the like, and having in the surface layer thereof one or more metal oxides selected from $SiO_2$, $Al_2O_3$ and $TiO_2$.

In Japanese Patent Laid-Open No. 2005-314176, the pore volume of the spherical ferrite particle is set at 0.05 ml/g or less, thus the pore volume is small, and no ferrite particle having a high magnetization and a high resistance is obtained. Additionally, the spherical ferrite particle is to be used for a resin-coated carrier, and hence does not acquire the advantage imparted to a resin-filled carrier.

In a carrier for an electrophotographic developer, the magnetization and the resistance are the important properties and the balance between the magnetization and the resistance is required.

For the purpose of establishing the balance between the magnetization and the resistance, ferrite carriers using heavy metals such as Cu, Zn and Ni, or Mn have been used.

Nowadays, the environmental regulations become strict, the use of heavy metals such as Ni, Cu and Zn has come to be avoided, and the use of the metals adaptable to the environmental regulations is demanded. Thus, the ferrite compositions used as the carrier core materials are changing over from the Cu—Zn ferrite and the Ni—Zn ferrite to Mn-based ferrites such as manganese ferrite and the Mn—Mg—Sr ferrite.

However, even Mn-based ferrites using Mn are becoming the objects of various legal regulations from the viewpoint of the environmental regulation. In addition to the restriction that the above-described various heavy metals are not contained, it is demanded that ferrites containing Mn in an as small as possible amount are used as carrier core materials.

Japanese Patent Laid-Open No. 2009-175666 describes a resin-filled carrier using a porous ferrite core material that has a specific pore volume and a specific pore size. However, as is clear from the examples in Japanese Patent Laid-Open No. 2009-175666, this porous ferrite core material contains Mn, and hence it is difficult to claim that the above-described environmental consideration is put into practice.

As shown in these conventional techniques, although heavy metals are not used and the Mn content is reduced to be as small as possible, the following have not yet been obtained: a porous ferrite core material for an electrophotographic developer which core material permits controlling the magnetization and the resistance over wide ranges, has a high charging property and is suitable for a resin-filled ferrite carrier; a resin-filled ferrite carrier which maintains the advantages of the conventional resin-filled carrier as well as the above-described features, and is small in the amount of aggregated particles; and an electrophotographic developer using this ferrite carrier.

SUMMARY OF THE INVENTION

Accordingly, an object of the present invention is to provide the following: a porous ferrite core material for an electrophotographic developer which core material permits controlling the magnetization and the resistance over wide ranges, has a high charging property and is suitable for a resin-filled ferrite carrier, although heavy metals are not used and the Mn content is reduced to be as small as possible; a resin-filled ferrite carrier which maintains the advantages of the conventional resin-filled carrier as well as the above-described features, and is small in the amount of aggregated particles; and an electrophotographic developer using this ferrite carrier.

For the purpose of solving such problems as described above, the present inventors made a diligent study, and have reached the present invention by discovering that the above-described object can be achieved by using, in a resin-filled ferrite carrier obtained by filling a resin in the voids of a porous ferrite core material, the porous ferrite core material including Mg, Ti and Fe, each in a predetermined amount, and having a pore volume, a peak pore size and a magnetic property each falling within a specific range.

Specifically, the present invention provides a porous ferrite core material for an electrophotographic developer, wherein the porous ferrite core material includes Mg in a content of 0.3 to 3% by weight, Ti in a content of 0.4 to 3% by weight and Fe in a content of 60 to 70% by weight, and the porous ferrite core material has a pore volume of 0.04 to 0.16 ml/g, a peak pore size of 0.4 to 1.6 μm, a saturation magnetization of 40 to 80 $Am^2/kg$, a remanent magnetization of less than 7 $Am^2/kg$ and a coercive force of less than 43 A/m.

The porous ferrite core material for an electrophotographic developer according to the present invention preferably includes Sr in a content of 2.5% by weight or less.

The porous ferrite core material for an electrophotographic developer according to the present invention has preferably been subjected to a surface oxidation treatment.

The present invention provides a resin-filled ferrite carrier for an electrophotographic developer, produced by filling a resin in the voids of the porous ferrite core material.

The resin-filled ferrite carrier for an electrophotographic developer according to the present invention is preferably filled with 6 to 30 parts by weight of the resin in relation to 100 parts by weight of the porous ferrite core material.

The resin-filled ferrite carrier for an electrophotographic developer of the present invention preferably has an apparent density of 1.4 to 2.5 $g/cm^3$.

The resin-filled ferrite carrier for an electrophotographic developer of the present invention preferably has a shape factor SF-1 of less than 130.

The resin-filled ferrite carrier for an electrophotographic developer of the present invention preferably has a bridge-type resistance of $5\times10^6$ to $1\times10^{12}$ ($\Omega$), with a 6.5-mm gap at an applied voltage of 250 V, a saturation magnetization of 38 to 76 $Am^2/kg$, a remanent magnetization of less than 8 $Am^2/kg$ and a coercive force of less than 50 A/m.

The surface of the resin-filled ferrite carrier for an electrophotographic developer of the present invention is preferably coated with a resin.

Additionally, the present invention provides an electrophotographic developer including the resin-filled ferrite carrier and a toner.

The electrophotographic developer of the present invention is also used as a refill developer.

Although heavy metals are not used and the Mn content is reduced to be as small as possible, the porous ferrite core material for an electrophotographic developer according to the present invention can attain an intended magnetization and an intended resistance while the pore volume and the peak pore size are being maintained so as to each fall in a specific range and fluidity is being ensured. Additionally the resin-filled ferrite carrier for an electrophotographic developer according to the present invention is a resin-filled ferrite carrier, hence achieves weight reduction, is excellent in durability and permits attaining a long operating life, is small in the amount of aggregated particles, and permits easy controlling of the charge amount and the resistance. Further, the resin-filled ferrite carrier for an electrophotographic developer according to the present invention is higher in strength as compared to magnetic powder-dispersed carriers, is free from the cracking, deformation and melting due to heat or impact. Thus, the electrophotographic developer using the resin-filled ferrite carrier achieves a long operation life and has a high charge amount.

DETAILED DESCRIPTION OF THE EMBODIMENTS

Hereinafter, the embodiments for carrying out the present invention are described.

<Porous Ferrite Core Material and Resin-Filled Ferrite Carrier for an Electrophotographic Developer According to the Present Invention>

The composition of the porous ferrite core material for an electrophotographic developer according to the present invention includes: Mg in a content of 0.3 to 3% by weight, preferably 0.4 to 3% by weight and more preferably 0.4 to 2.9% by weight; Ti in a content of 0.4 to 3% by weight, preferably 0.5 to 3% by weight and more preferably 0.5 to 2.5% by weight; and Fe in a content of 60 to 70% by weight, preferably 62 to 70% by weight and more preferably 64 to 70% by weight. Within the above-described composition ranges, a high resistance is obtained while the magnetization is high, and when the porous ferrite core material is used as a carrier for an electrophotographic developer, the charging property is also stable and satisfactory.

With respect to Mg, MgO is inclined to the plus side in the electronegativity scale and hence Mg is compatible with minus toners to an extreme extent, and thus a developer, satisfactory in initial rate of charge, constituted with a magnesium ferrite carrier containing MgO and a full-color toner can be obtained.

Ti is slightly inclined, in terms of $TiO_2$, to the minus side in the electronegativity scale and hence Ti is, in principle, incompatible with minus toners; however, the Ti content regulated to fall within a range of less than 3% by weight enables to restrict the effect of Ti to the minimum as far as the charging property is concerned.

The Fe content of less than 60% by weight means that the addition amount of Mg and/or Ti is relatively increased to increase the nonmagnetic component and/or the low magnetization component, and hence no intended magnetic properties are obtained; the Fe content exceeding 70% by weight does not attain the effects of the addition of Mg and/or Ti and results in a porous ferrite core material (carrier core material) substantially equivalent to $Fe_3O_4$. The best Mg content is approximately such that the ratio Mg:divalent Fe=1:1 to 1:4. The Mg content of less than 0.4% by weight decreases the production amount of the magnesium ferrite phase in the carrier core material and relatively increases the production amount of the $Fe_3O_4$ phase to increase the coercive force, and hence results in a possibility that no intended magnetic properties are obtained; the Mg content exceeding 3% by weight increases the production amount of magnesium ferrite in the carrier core material, and hence results in a possibility that no intended magnetic properties are obtained. The Ti content of less than 0.4% by weight does not provide the effect of lowering the sintering temperature due to the inclusion of Ti, and hence results in a possibility that no core material particle having the intended surface property is obtained; the Ti content exceeding 3% by weight makes predominant the nonmagnetic phase due to the composite oxide between Fe and Ti to cause a too low magnetization, and hence results in a possibility that no intended magnetic properties are obtained. The contained amount of divalent Fe can be grasped by the crystal structure analysis with powder X-ray diffraction, or by redox titration with potassium permanganate or potassium dichromate when the Mn content is small and hence redox titration can be performed.

The porous ferrite core material used in the present invention preferably includes Sr in a content of 2.5% by weight or less. When the Sr content exceeds 2.5% by weight, the porous ferrite core material starts changeover to hard ferrite, and hence there is a possibility that the fluidity of the developer is rapidly degraded on a magnetic brush.

It is to be noted that examples of the crystal structure of the oxides containing Sr and Fe include a strontium ferrite represented by $SrO.6Fe_2O_3$ or $SrFe_{12}O_{19}$. The porous ferrite core material used in the present invention may contain such a strontium ferrite to an extent that the fluidity of the porous ferrite core material, as a core material and a carrier, is not impaired.

The porous ferrite core material used in the present invention may contain Mn in a small amount. The Mn content is 1% by weight or less, preferably 0.001 to 0.9% by weight and more preferably 0.001 to 0.8% by weight. Mn may be intentionally added according to the intended applications for the purpose of improving the balance between the resistance and the magnetization. In this case, in particular there can be expected an effect of preventing the reoxidation at the time of taking out from the furnace in sintering. In the case where no intentional addition of Mn is possible, the inclusion of a trace amount of Mn as an impurity originating from the raw material causes no problem. The form of Mn at the time of addition is not particularly limited; however, $MnO_2$, $Mn_2O_3$, $Mn_3O_4$ and $MnCO_3$ are preferable because of easy industrial availability.

The carrier core material for an electrophotographic developer according to the present invention preferably contains Si, and the Si content is preferably 5 to 1000 ppm and more preferably 20 to 800 ppm. The inclusion of Si enables to perform sintering at a low temperature and hence no aggregated particles are generated. Additionally, the inclusion of Si allows sintering to proceed to an appropriate extent, and hence a targeted high magnetization is obtained in a sintering at a comparatively low temperature, without containing Mn in a large amount.

(Contents of Fe, Mg, Ti, Sr, Mn and Si)

The contents of Fe, Mg, Ti, Sr, Mn and Si are measured as follows.

A porous ferrite core material (carrier core material) is weighed out in an amount of 0.2 g, a solution prepared by adding 20 ml of 1N hydrochloric acid and 20 ml of 1N nitric acid to 60 ml of pure water is heated, the carrier core material is completely dissolved in the solution to prepare an aqueous solution, and the contents of Fe, Mg, Ti, Sr, Mn and Si are measured with an ICP analyzer (ICPS-10001V, manufactured by Shimadzu Corp.).

In the porous ferrite core material of an electrophotographic developer according to the present invention, the pore volume thereof is required to be 0.04 to 0.16 ml/g and the peak pore size thereof is required to be 0.4 to 1.6 μm, the pore volume of the porous ferrite being preferably 0.05 to 0.15 ml/g and the peak pore size of the porous ferrite being preferably 0.5 to 1.5 μm.

When the pore volume of the porous ferrite core material is less than 0.04 ml/g, no sufficient amount of resin can be filled and hence no weight reduction is achieved. On the other hand, when the pore volume of the porous ferrite core material exceeds 0.16 ml/g, the strength of the carrier cannot be maintained even by filling a resin.

When the peak pore size of the porous ferrite core material is less than 0.4 μm, it is remarkably difficult to fill a resin into the central portion of the core material. On the other hand, when the peak pore size of the porous ferrite core material exceeds 1.6 μm, unpreferably the carrier after filling undergoes the occurrence of immoderate asperities to make poor the particle strength and to offer causes for charge leakage and toner spent.

As described above, the pore volume and the peak pore size falling within the above-described ranges enable to obtain a resin-filled ferrite carrier which is free from the above-described failures and is appropriately reduced in weight.

(Pore Size and Pore Volume of Porous Ferrite Core Material)

The measurement of the pore size and the pore volume of the porous ferrite core material is conducted as follows. Specifically, the measurement is conducted with the mercury porosimeters, Pascal 140 and Pascal 240 (manufactured by Thermo Fisher Scientific K.K.). A dilatometer CD3P (for powder) is used, and a sample is put in a commercially available gelatin capsule with a plurality of bored holes and the capsule is placed in the dilatometer. After deaeration with Pascal 140, mercury is charged and a measurement in the lower pressure region (0 to 400 kPa) is conducted as a first run. Successively, the deaeration and another measurement in the lower pressure region (0 to 400 kPa) are conducted as a second run. After the second run, the total weight of the dilatometer, the mercury, the capsule and the sample is measured. Next, a higher pressure region (0.1 MPa to 200 MPa) measurement is conducted with Pascal 240. From the amount of the intruded mercury as measured in the higher pressure region measurement, the pore volume, the pore size distribution and the peak pore size of the porous ferrite core material are derived. The pore size is derived with the surface tension and the contact angle of mercury of 480 dyn/cm and 141.3°, respectively.

The carrier core material for an electrophotographic developer according to the present invention includes, in addition to the spinel structure that includes Mg, at least a crystal structure of an oxide that includes Fe and Ti. Only the resistance can be controlled without changing the magnetization as follows: a carrier core material is produced by adding Ti to an Fe-excess magnesium ferrite, in a magnetization range needing a relatively-low-magnetization composite oxide including Fe and Ti as well as a spinel-crystal-structure compound constituting a common ferrite, and by oxidizing, at the time of the surface oxidation treatment, the composite oxide that includes Fe and Ti in preference to the spinel phase. In other words, the resistance is adjusted by changing the valency of Fe included in the composite oxide including Fe and Ti. The crystal structure is measured as follows.

(Measurement of Crystal Structure: X-Ray Diffraction Measurement)

Used as a measurement apparatus is "X'PertPRO MPD" manufactured by Panalytical Co., Ltd. A Co X-ray tube (Co Kα ray) as an X-ray source, a focusing optical system as an optical system and a fast detector "X'Celarator" are used, and the measurement is conducted with a continuous scan of 0.2°/sec. The measurement results are subjected to data processing by using an analysis software "X'Pert HighScore" in the same manner as in the usual crystal structure analysis of powders, and thus the crystal structures are identified. By refining the obtained crystal structures, the content proportions of the individual crystal structures in terms of weight are derived. In the derivation of the content proportions, the peaks of magnesium ferrite and the peaks of $Fe_3O_4$ are difficult to separate from each other and hence magnesium ferrite and $Fe_3O_4$ are collectively treated as the spinel phase, and the respective content proportions of the other crystal structures are derived. It is to be noted that in performing the crystal structure identification, Fe and O are taken as essential elements and Mn, Mg, Ti and Sr are taken as the elements which are possibly contained. Additionally, measurement can also be conducted with a Cu X-ray tube as an X-ray source without any problem; however, in the case where the sample contains Fe abundantly, the background is higher as compared to the peaks to be the measurement targets when a Cu X-ray tube is used, and hence the use of a Co X-ray tube is preferable. As for the optical system, a parallel optical method may also yield the same results, but the parallel optical method results in a low X-ray intensity to make longer the measurement time, and hence measurement with a focusing optical system is preferable. Further, the continuous scanning speed is not particularly limited; however, for the purpose of obtaining a S/N ratio sufficient to perform the crystal structure analysis, the measurement is conducted under the conditions that the peak intensity of the most intense plane (113) of the spinel structure is set to be 50000 cps or more, and a carrier core material is set in a sample cell in such a way that the carrier core material particles are free from orientation in a specific preferential direction.

$MgFe_2O_4$ is typical as the spinel structure constituting the magnesium ferrite; however, as can be seen from the elemental component ratios, Fe is excessive, and hence the spinel structure is defined to include: the crystal structures in each of which Mg is partially substituted with Fe to be formally represented by $Mg_xFe_{1-x}O_4/(Mg_xFe_{1-x})(Mg_{x'}Fe_{1-x'})_2O_4$ or the like; all the crystal structures in which the aforementioned crystal structures are partially substituted with one or more elements of Mn, Ti and Sr; and also the crystal structures in which lattice defects are periodically included in the spinel structure by sintering in a nonoxidative atmosphere.

In addition to magnesium ferrite, $Fe_3O_4$ is measured as the spinel structure as the case may be; however, $Fe_3O_4$ as referred to in the present invention is defined to include, in addition to $Fe_3O_4$: the structures in which the ratio of Fe to O is 2.5:4 to 3:4; further all the structures in which Fe of $Fe_3O_4$ is partially substituted with Mg and one or more elements of Mn, Ti and Sr; and also the structures in which lattice defects are periodically included in the spinel structure by sintering in a nonoxidative atmosphere.

As the crystal structure of an oxide including Fe and Ti, $Fe_2TiO_4$ is typical as a spinel structure, and $FeTiO_3$ and $Fe_2TiO_5$ are typical as the crystal structures other than the spinel structure. The crystal structure of the oxide including Fe and Ti is defined to include: the crystal structures in which the contained amount of Fe is predominantly larger than the contained amount of Ti, and which are represented by $Fe_xTiO_y$, and additionally by $(FeTiO_3)_x(Fe_2O_3)_y$, $Fe(Fe_xTi_y)O_4$, $(Fe_xTi_{1-x})(Fe_{x'}Ti_{1-x'})O_4$ and the like; the crystal structures in which the aforementioned crystal structures are partially substituted with Mn and/or Sr; and further the crystal structures in which lattice defects are periodically included in the above-described crystal structures by sintering in a nonoxidative atmosphere. The crystal structure of the oxide including Fe and Ti is also defined to include, in addition to the above-described crystal structures: all the oxides in which a strontium ferrite precursor $Sr_aFe_bO_c$ is partially substituted with Ti and/or Mn to be represented by $Sr_aFe_bTi_cO_d$, $Sr_aFe_bMn_cTi_dO_e$ and the like; and also the crystal structures in which oxygen defects and/or lattice defects are periodically included in the above-described crystal structures by sintering in a nonoxidative atmosphere. In particular, the strontium ferrite precursor $Sr_aFe_bO_c$ is more preferable because this precursor is made to tend to take an oxygen-deficient perovskite structure by sintering in a nonoxidative atmosphere, is higher in dielectric constant than ferrites and accordingly tends to be easily polarized in the core material according to the present invention, and hence can be expected to achieve an improvement of the charging property as a carrier.

The carrier core material for an electrophotographic developer according to the present invention may also include, in addition to the oxides including Fe, as the oxides including Ti, materials having a perovskite structure higher in dielectric constant than ferrites. Specifically, the inclusion of $MgTiO_3$, $Mg_2TiO_4$ and/or $SrTiO_3$ is more preferable because the core material described in the present invention is made to be easily polarizable and can be expected to achieve an improvement of the charging property as a carrier. These materials having a perovskite structure may be present in the core material as solid solutions formed with oxides including Fe. On the other hand, $CaTiO_3$, as a Ca compound originating from the raw material, may be contained as an impurity; however, an intentional addition of $CaTiO_3$ is inappropriate because the sintering aid effect of Ca is strong and no intended porous properties are obtained. Additionally, $BaTiO_3$ is high in dielectric constant, but no inclusion of $BaTiO_3$ is preferable in consideration of the environmental aspect.

The saturation magnetization of the porous ferrite core material for an electrophotographic developer according to the present invention is 40 to 80 $Am^2/kg$. When the saturation magnetization is less than 40 $Am^2/kg$, unpreferably a cause for carrier beads carry over is offered. When the saturation magnetization exceeds 80 $Am^2/kg$, the ear of a magnetic brush is hardened, and hence it is difficult to obtain a satisfactory image quality. Additionally, the remanent magnetization is less than 7 $Am^2/kg$. When the remanent magnetization is 7 $Am^2/kg$ or more, the carrier particles tend to aggregate on the magnetic brush to lead to poor fluidity, and such remanent magnetization possibly offers a cause for image density unevenness, and additionally, the carrier particles continue to aggregate in the developing device to preclude sufficient mixing by stirring with the toner to lead to a possibility of failing in uniform charging of the toner. The coercive force of the porous ferrite core material is less than 43 A/m. When the coercive force is 43 A/m or more, the carrier particles tend to aggregate on the magnetic brush to be poor in fluidity, and such coercive force possibly offers a cause for image density unevenness.

(Magnetic Properties)

The magnetic properties are measured as follows. Specifically, the magnetic properties are measured with an integral-type B-H tracer, model BHU-60 (manufactured by Riken Denshi Co., Ltd.). An H coil for measuring magnetic field and a 4πI coil for measuring magnetization are inserted between the electromagnet pole pieces. In this case, a sample is placed in the 4πI coil. By integrating each of the outputs from the H coil and the 4πI coil while the magnetic field H is being varied by varying the current of the electromagnet, a hysteresis loop is depicted on a sheet of recording paper with the H output on the X-axis and the 4πI coil output on the Y-axis. Here, the measurement is conducted under the following measurement conditions: the sample filling quantity is approximately 1 g; the sample filling cell has an inner diameter of 7 mmϕ±0.02 mm and a height of 10 mm±0.1 mm; and the number of turns of the 4πI coil is 30.

The porous ferrite core material for an electrophotographic developer according to the present invention is preferably subjected to a surface oxidation treatment. The surface oxidation treatment forms a surface film, and the thickness of the surface film is preferably 0.1 nm to 5 μm. When the thickness of the surface film is less than 0.1 nm, the effect of the oxide coating film is small, and when the thickness of the surface film exceeds 5 μm, obviously the magnetization is degraded or the electric resistance becomes too high, and thus a problem such that the developing power is degraded tends to be caused. Additionally, where necessary, reduction may be conducted before the oxidation treatment. The thickness of the oxide coating film can be measured from a SEM photograph, with an optical microscope and a laser microscope, each having such a high magnification that permits identification of the formation of the oxide coating film. It is to be noted that the oxide coating film may be formed uniformly or partially on the surface of the core material.

The resin-filled ferrite carrier for an electrophotographic developer according to the present invention is obtained by filling a resin in the voids of a porous ferrite core material.

The resin-filled ferrite carrier for an electrophotographic developer according to the present invention is obtained by filling a porous ferrite core material with a resin. The filling amount of the resin is preferably 6 to 30 parts by weight, more preferably 6 to 20 parts by weight, furthermore preferably 7 to 18 parts by weight and most preferably 8 to 17 parts by weight in relation to 100 parts by weight of the porous ferrite core material. When the filling amount of the resin is less than 6 parts by weight, no sufficient weight reduction is attained. On the other hand, when the filling amount of the resin exceeds 30 parts by weight, the free resin remaining as unused for filling occurs in a large amount to offer causes for failures such as charging failure.

The filling resin is not particularly limited, and can be appropriately selected depending on the toner to be combined therewith, the use environment and the like. Examples of the filling resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin, or a fluororesin. In consideration of the exfoliation of the resin due to the mechanical stress during use, thermosetting resins are preferably used. Specific examples of the thermosetting resins include epoxy resins, phenolic resins, silicone resins, unsaturated polyester resins, urea resins, melamine resins, alkyd resins and resins containing these resins.

For the purpose of controlling the electric resistance and the charge amount and the charging rate of the carrier, a conductive agent can be added in the filling resin. The electric resistance of the conductive agent itself is low, and hence when the addition amount of the conductive agent is too large, a rapid charge leakage tends to occur. Accordingly, the addition amount of the conductive agent is 0.25 to 20.0% by weight, preferably 0.5 to 15.0% by weight and particularly preferably 1.0 to 10.0% by weight in relation to the solid content of the filling resin. Examples of the conductive agent include conductive carbon, oxides such as titanium oxide and tin oxide, and various organic conductive agents.

Additionally, a charge controlling agent can be contained in the filling resin. Examples of the charge controlling agent include various types of charge controlling agents generally used for toners and various silane coupling agents. This is because when a resin is filled in a large amount, the charge imparting ability is degraded as the case may be, but the addition of various charge controlling agents and silane coupling agents permits controlling the charge imparting ability. The types of the usable charge controlling agents and coupling agents are not particularly limited; however, preferable are charge controlling agents such as nigrosine dyes, quaternary ammonium salts, organometallic complexes and metal-containing monoazo dyes, and coupling agents such as aminosilane coupling agents and fluorine-based silane coupling agents.

In the resin-filled ferrite carrier for an electrophotographic developer according to the present invention, the surface thereof is preferably coated with a coating resin. The carrier properties, in particular, the electric properties including the charging property are frequently affected by the materials present on the carrier surface and by the properties and conditions of the carrier surface. Accordingly, by coating the surface of the carrier with an appropriate resin, intended carrier properties can be regulated with a satisfactory accuracy.

The coating resin is not particularly limited. Examples of the coating resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin, or a fluororesin. In consideration of the exfoliation of the resin due to the mechanical stress during use, thermosetting resins are preferably used. Specific examples of the thermosetting resins include epoxy resins, phenolic resins, silicone resins, unsaturated polyester resins, urea resins, melamine resins, alkyd resins and resins containing these resins. The coating amount of the resin is preferably 0.5 to 5.0 parts by weight in relation to 100 parts by weight of the resin-filled carrier (before resin coating).

In these coating resins, for the same purposes as described above, conductive agents or charge controlling agents may be contained. The types and the addition amounts of the conductive agents or the charge controlling agents are the same as in the case of the filling resin.

The volume average particle size of the resin-filled carrier for an electrophotographic developer according to the present invention is preferably 20 to 60 μm, and with this range the carrier beads carry over is prevented and satisfactory image quality is obtained. When the volume average particle size is less than 20 μm, unpreferably such a particle size offers a cause for the carrier beads carry over. When the average particle size exceeds 60 μm, unpreferably such a particle size offers a cause for the image quality degradation due to the degradation of the charge imparting ability.

(Average Particle Size (Microtrac))

The average particle size is measured as follows. In other words, the average particle size is measured with a laser diffraction particle size distribution analyzer. Specifically, the average particle size is measured with Microtrac Particle Size Analyzer (model 9320-X100) manufactured by Nikkiso Co., Ltd. Water is used as a dispersion medium. In a 100-ml beaker, 10 g of a sample and 80 ml of water are placed, and a few drops of a dispersant (sodium hexametaphosphate) are added in the beaker. Next, the mixture thus obtained is subjected to dispersion for 20 seconds with an ultrasonic homogenizer (model UH-150, manufactured by SMT Co., Ltd.) set at an output power level of 4. Thereafter, the foam formed on the surface of the dispersed mixture in the beaker is removed and the dispersed mixture is placed as a sample in the measurement apparatus.

The true density of the resin-filled ferrite carrier for an electrophotographic developer according to the present invention is preferably 2.5 to 4.5 g/cm$^3$. When the true density is less than 2.5 g/cm$^3$, the carrier is too lightweight and hence the charge imparting ability tends to be degraded. When the true density exceeds 4.5 g/cm$^3$, the weight reduction of the carrier is not sufficient and the durability of the carrier becomes poor.

(True Density)

The true density is measured as follows. Specifically, the measurement is conducted in conformity with JIS R9301-2-1 by using a pycnometer. Ethanol is used as a solvent, and the measurement is conducted at a temperature of 25° C.

The apparent density of the resin-filled carrier for an electrophotographic developer according to the present invention is preferably 1.4 to 2.5 g/cm$^3$. When the apparent density is less than 1.4 g/cm$^3$, the carrier is too lightweight and hence the charge imparting ability tends to be degraded. When the apparent density exceeds 2.5 g/cm$^3$, the weight reduction of the carrier is not sufficient and the durability of the carrier becomes poor.

(Apparent Density)

The apparent density is measured in conformity with JIS-Z-2504. The details are as follows.

1. Apparatus

A powder apparent density meter composed of a funnel, a cup, a funnel supporter, a supporting rod and a supporting base is used. A balance having a weighting capacity of 200 g and a weighing sensitivity of 50 mg is used.

2. Measurement Method (1) A sample weighs at least 150 g or more.

(2) The sample is poured into the funnel having an orifice with an orifice aperture size of $2.5^{+0.2/-0}$ mm until the sample flowing from the funnel into a cup fills the cup and starts to brim over the cup.

(3) When the sample starts to brim over the cup, immediately the pouring of the sample is stopped, and the heaped portion of the sample is removed with a spatula, without shaking the sample, along the top edge of the cup so as for the top surface of the sample to be flat.

(4) The side of the cup is lightly tapped to lower the sample, the sample attaching to the outside of the cup is removed, and the sample inside the cup is weighed to a precision of 0.05 g.

3. Calculation

The measured value, obtained in the previous item 2-(4) is multiplied with 0.04, and the value thus obtained is rounded to the second decimal place according to JIS-Z8401 (method for rounding numerical values) to be defined as an apparent density given in units of g/cm$^3$.

In the resin-filled ferrite carrier for an electrophotographic developer according to the present invention, the shape factor SF-1 (circularity) is preferably less than 130. The shape factor is a value obtained by calculation with the following formula, and is a value the closer to 100 the closer to a sphere the shape of the carrier is. The shape factor SF-1 of the carrier of 130 or more means that the asperities on the surface of the particles of the resin-filled ferrite carrier for an electrophotographic developer are large and the carrier particles aggregate, to lead to a possibility that no intended properties as a carrier for electrophotography are obtained. The shape factor SF-1 (circularity) is measured as follows.

(Shape Factor SF-1 (Circularity))

By using a grain size/shape distribution analyzer PITA-1 manufactured by Seishin Enterprise Co., Ltd., 3000 particles of a resin-filled ferrite carrier for an electrophotographic developer are observed, and the Area (projected area) and the Feret diameter (maximum) are derived with the software, ImageAnalysis, appended to the apparatus, and the shape factor SF-1 is derived with the following formula. The shape factor is a value the closer to 100 the closer to a spherical shape the shape of the carrier is. The shape factor SF-1 is obtained for each of the particles, and the average value over 3000 particles is defined as the shape factor SF-1 of the carrier.

A sample solution is prepared as follows: an aqueous solution of xanthane gum, having a viscosity of 0.5 Pa·s is prepared as a dispersion medium, and 0.1 g of carrier particles are dispersed in 30 cc of the aqueous solution of xanthane gum to be used as the sample solution. Such a proper adjustment of the dispersion medium viscosity allows the carrier particles to maintain the condition of being kept dispersed and thus allows the measurement to be performed smoothly. The measurement conditions are as follows: the magnification of the (objective) lens is 10×; the filters are ND4×2; for each of the carrier solution 1 and the carrier solution 2, the aqueous solution of xanthane gum, having a viscosity of 0.5 Pa·s is used; the flow rate of either of the carrier solutions 1 an 2 is 10 μl/sec, and the flow rate of the sample solution is 0.08 μl/sec.

$$SF\text{-}1=(R^2/S)\times(\pi/4)\times 100$$

R: Feret diameter (maximum), S: Area

The resin-filled ferrite carrier for an electrophotographic developer according to the present invention preferably has a bridge-type resistance of $5\times10^6$ to $1\times10^{12}$ (Ω), with a 6.5-mm gap at an applied voltage of 250 V. The resistance less than $5\times10^6$ (Ω) offers a cause for generation of white spots due to the charge leakage at the time of development. The resistance exceeding $1\times10^{12}$ (Ω) is too high and makes the charge transfer to the toner difficult to occur, and thus causes charge degradation and offers a cause for toner scattering. The resistance is measured as follows.

(Resistance)

The nonmagnetic parallel plate electrodes (10 mm×40 mm) are made to face each other with an inter-electrode gap of 6.5 mm, and a sample weighed out to be 200 mg is filled between the electrodes. A magnet (surface magnetic flux density: 1500 Gauss, the area of the magnet in contact with each of the electrodes: 10 mm×30 mm) is fixed to the parallel plate electrodes to hold the sample between the electrodes, a voltage of 250 V is applied, and the resistance is measured with an insulation resistance meter (SM-8210, manufactured by Toa DKK Co., Ltd.). It is to be noted that the measurement is conducted in a constant-temperature constant-humidity room set at a room temperature of 25° C. and a humidity of 55%.

<Method for Producing the Porous Ferrite Core Material for an Electrophotographic Developer and the Resin-Filled Ferrite Carrier According to the Present Invention>

Next, description is made on the method for producing the porous ferrite core material for an electrophotographic developer and the resin-filled ferrite carrier according to the present invention.

For the purpose of producing the porous ferrite core material for an electrophotographic developer according to the present invention, first, raw materials are weighed out in appropriate amounts, and are mixed together with a mixer such as a Henschel mixer for 0.1 hour or more, preferably 0.1 to 5 hours. The raw materials are not particularly limited; however, it is preferable to select the materials so as to result in the composition including the above-described elements.

The mixture thus obtained is converted into a pellet with a compression molding machine or the like, and then the pellet is calcined at a temperature of 700 to 1200° C. The calcination conditions are preferably such that the calcination is conducted in a nonoxidative atmosphere or in an atmosphere having an oxygen concentration of 2% by volume or less. Without using a compression molding machine, after pulverizing the mixture, the pulverized mixture may be converted into a slurry by adding water thereto, and the slurry may be converted into particles by using a spray dryer. After the calcination, further pulverization is conducted with a ball mill, a vibration mill or the like, thereafter water and, where necessary, a dispersant, a binder and the like are added, the viscosity is adjusted, and then particles are prepared with a spray dryer for granulation. In this case, the slurry particle size is preferably 3 to 6.5 μm. In the pulverization after the calcination, pulverization may also be conducted by adding water with a wet ball mill, a wet vibration mill or the like.

The above-described pulverizing machine such as the ball mill or the vibration mill is not particularly limited; however, for the purpose of effectively and uniformly pulverizing the raw materials, it is preferable to adopt fine beads having a particle size of 5 mm or less as the media to be used. By regulating the size and the composition of the beads used and the pulverization time, the degree of pulverization can be controlled.

Thereafter, the granulated substance thus obtained is maintained and sintered in an oxygen concentration-controlled atmosphere at a temperature of 850 to 1100° C. for 1 to 24 hours. In this case, a rotary electric furnace, a batch electric furnace, a continuous electric furnace or the like is used, and the atmosphere at the time of sintering may be controlled with respect to the oxygen concentration by introducing an inert gas such as nitrogen or a reducing gas such as hydrogen or carbon monoxide. Additionally, in the case of the rotary electric furnace, sintering may be repeated multiple times under variation of the atmosphere and/or the sintering temperature.

The sintered substance thus obtained is pulverized and classified. As the classification method, the existing methods such as a pneumatic classification method, a mesh filtration method and a precipitation method are used to regulate the particle size to an intended particle size.

Thereafter, where necessary, by applying low temperature heating to the surface, an oxide coating treatment is conducted and thus electric resistance can be regulated. In the oxide coating treatment, a common rotary electric furnace, a common batch electric furnace or the like is used to allow the heat treatment to be conducted, for example, at 180 to 500° C. The thickness of the oxide coating film formed by this treatment is preferably 0.1 nm to 5 μm. When the thickness is less than 0.1 nm, the effect of the oxide coating film is small, and when the thickness exceeds 5 μm, the magnetization is degraded or the resistance becomes too high, and thus unpreferably intended properties are hardly obtained. Where necessary, reduction may be conducted before the oxide coating treatment. In this way, the porous ferrite core material having a pore volume and a peak pore size falling within the specific ranges can be prepared.

As such methods as described above for the controlling of the pore volume, the peak pore size and the saturation magnetization of the ferrite core material for an electrophotographic developer, the above-described controlling can be performed by various methods involving the types of the raw materials to be mixed, the pulverization degree of the raw materials, the application or nonapplication of calcination, the calcination temperature, the calcination time, the amount of the binder at the time of granulation with a spray dryer, the sintering method, the sintering temperature, the sintering time, the reduction with hydrogen gas, carbon monoxide gas or the like. These controlling methods are not particularly limited, and an example of such methods is described below.

Specifically, the use of hydroxides or carbonates as the raw materials to be mixed tends to increase the pore volume as compared to the use of oxides; additionally, nonapplication of calcination or a lower calcination temperature, or a lower sintering temperature combined with a shorter sintering time tends to increase the pore volume.

The peak pore size tends to be small by enhancing the degree of pulverization of the raw materials used, in particular, the raw materials having been calcined so as to make fine the primary particle size in the pulverization. In the sintering, rather than the use of an inert gas such as nitrogen, the introduction of a reducing gas such as hydrogen or carbon monoxide enables to reduce the peak pore size.

The control of the magnetic properties such as saturation magnetization can be performed by the surface oxidation treatment of the porous core material particles as well as by varying the composition proportions of Mg, Fe, Ti and Sr. Additionally, the degree of reduction in the sintering can also be controlled by varying the addition amount of the binder at the time of the granulation.

By using these controlling methods each alone or in combinations thereof, a porous ferrite core material having the intended pore volume, peak pore size and saturation magnetization can be obtained.

By filling a resin in the thus obtained porous ferrite core material for an electrophotographic developer according to the present invention, a resin-filled ferrite carrier for an electrophotographic developer is prepared. As the filling method, various methods are available. Examples of the filling method include: a dry method, a spray drying method based on a fluidized bed, a rotary drying method and a dip-and-dry method using a universal stirrer or the like. The resins to be used herein are as described above.

In the step of filling the resin, it is preferable to fill the resin in the pores of the porous ferrite core material while the porous ferrite core material and the filling resin are being mixed under stirring under reduced pressure. Such filling of the resin under reduced pressure enables to efficiently fill the resin in the pores. The degree of the pressure reduction is preferably such that the pressure falls in the range from 10 to 700 mmHg. When the pressure exceeds 700 mmHg, no effect of the pressure reduction is attained, and when the pressure is less than 10 mmHg, the resin solution tends to boil during the filling step so as to preclude efficient filling.

The step of filling the resin is preferably conducted as a plurality of steps. It is possible to fill the resin in one step. Thus, it is not necessary to dare to divide the filling step into a plurality of steps. However, depending on the type of the resin, an attempt to fill a large amount of the resin at a time leads to the occurrence of the aggregation of the carrier particles as the case may be. When the carrier is used as a carrier in a developing device, such aggregation of the carrier particles undergoes disintegration due to the stirring stress in the developing device as the case may be. The interface in the aggregated carrier particles is largely different in the charging property, and hence unpreferably the charge variation of the carrier occurs during passage of time. In such a case, the filling step divided into a plurality of steps enables to conduct the filling in a just enough manner while the aggregation is being prevented.

After the filling of the resin, where necessary, heating is conducted with various methods, so as to make the filled resin adhere to the core material. The heating method may be either an external heating method or an internal heating method; for example, a fixed electric furnace, a fluidized electric furnace, a rotary electric furnace or a burner furnace may be used, or baking with microwave may also be adopted. The heating temperature is varied depending on the filing resin; the heating temperature is required to be a temperature equal to or higher than the melting point or the glass transition point; when a thermosetting resin, a condensation-crosslinking resin or the like is used, by increasing the heating temperature to a temperature allowing the curing to proceed sufficiently, a resin-filled carrier that has resistance against impact can be obtained.

After the resin has been filled in the porous ferrite core material as described above, the surface of the core material is preferably coated with a resin. The carrier properties, in particular, the electric properties including the charging property are frequently affected by the materials present on the carrier surface and by the properties and conditions of the carrier surface. Accordingly, by coating the surface of the core material with an appropriate resin, intended carrier properties can be regulated with a satisfactory accuracy. As the method for coating, heretofore known methods such as a brush coating method, a dry method, a spray drying method based on a fluidized bed, a rotary drying method and a dip-and-dry method using a universal stirrer can be applied for coating. For the purpose of improving the coverage factor, the method based on a fluidized bed is preferable. When baking is conducted after the resin coating, either an external heating method or an internal heating method may be used; for example, a fixed electric furnace, a fluidized electric furnace, a rotary electric furnace or a burner furnace may be used, or baking with microwave may also be adopted. When a UV curable resin is used, a UV heater is used. The baking temperature is varied depending on the resin used; the baking temperature is required to be a temperature equal to or higher than the melting point or the glass transition point; when a thermosetting resin, a condensation-crosslinking resin or the like is used, the baking temperature is required to be increased to a temperature allowing the curing to proceed sufficiently.

<Electrophotographic Developer According to the Present Invention>

Next, the electrophotographic developer according to the present invention is described.

The electrophotographic developer according to the present invention is composed of the above-described resin-filled ferrite carrier for an electrophotographic developer and a toner.

Examples of the toner particle that constitutes the electrophotographic developer of the present invention include a pulverized toner particle produced by a pulverizing method and a polymerized toner particle produced by a polymerization method. In the present invention, the toner particle obtained by either of these methods can be used.

The pulverized toner particle can be obtained, for example, by means of a method in which a binder resin, a charge controlling agent and a colorant are fully mixed together with a mixing machine such as a Henschel mixer, then the mixture thus obtained is melt-kneaded with an apparatus such as a double screw extruder, and the melt-kneaded substance is cooled, pulverized and classified, added with an external additive, and thereafter mixed with a mixing machine such as a mixer to yield the pulverized toner particle.

The binder resin that constitutes the pulverized toner particle is not particularly limited. However, examples of the binder resin may include polystyrene, chloropolystyrene, styrene-chlorostyrene copolymer, styrene-acrylate copolymer and styrene-methacrylic acid copolymer, and further, rosin-modified maleic acid resin, epoxy resin, polyester resin and polyurethane resin. These binder resins are used each alone or as mixtures thereof.

As the charge controlling agent, any charge controlling agent can be used. Examples of the charge controlling agent for use in positively charged toners may include nigrosine dyes and quaternary ammonium salts. Additionally, examples of the charge controlling agent for use in negatively charged toners may include metal-containing monoazo dyes.

As the colorant (coloring material), hitherto known dyes and pigments can be used. Examples of the usable colorant include carbon black, phthalocyanine blue, permanent red, chrome yellow and phthalocyanine green. Additionally, for the purpose of improving the fluidity and the anti-aggregation property of the toner, external additives such as a silica powder and titania can be added to the toner particle according to the toner particle.

The polymerized toner particle is a toner particle produced by heretofore known methods such as a suspension polymerization method, an emulsion polymerization method, an emulsion aggregation method, an ester extension polymerization method and a phase inversion emulsion method. Such a polymerized toner particle can be obtained, for example, as follows: a colorant dispersion liquid in which a colorant is dispersed in water with a surfactant, a polymerizable monomer, a surfactant and a polymerization initiator are mixed together in a aqueous medium under stirring to disperse the polymerizable monomer by emulsification in the aqueous medium; the polymerizable monomer thus dispersed is polymerized under stirring for mixing; thereafter, the polymer particles are salted out by adding a salting-out agent; the particles obtained by salting-out are filtered off, rinsed and dried, and thus the polymerized toner particles can be obtained. Thereafter, where necessary, an external additive can also be added to the dried toner particles for the purpose of imparting functions.

Further, when the polymerized toner particle is produced, in addition to the polymerizable monomer, the surfactant, the polymerization initiator and the colorant, a fixability improving agent and a charge controlling agent can also be mixed; the various properties of the obtained polymerized toner particle can be controlled and improved by these agents. Additionally, a chain transfer agent can also be used for the purpose of improving the dispersibility of the polymerizable monomer in the aqueous medium and regulating the molecular weight of the obtained polymer.

The polymerizable monomer used in the production of the polymerized toner particle is not particularly limited. However, example of such a polymerizable monomer may include: styrene and the derivatives thereof; ethylenically unsaturated monoolefins such as ethylene and propylene; vinyl halides such as vinyl chloride; vinyl esters such as vinyl acetate; and α-methylene aliphatic monocarboxylic acid esters such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used when the polymerized toner particle is prepared, hitherto known dyes and pigments can be used. Examples of the usable colorant include carbon black, phthalocyanine blue, permanent red, chrome yellow and phthalocyanine green. Additionally, the surface of each of these colorants may be modified by using a silane coupling agent, a titanium coupling agent or the like.

As the surfactant used in the production of the polymerized toner particle, anionic surfactants, cationic surfactants, amphoteric surfactants and nonionic surfactants can be used.

Here, examples of the anionic surfactants may include: fatty acid salts such as sodium oleate and castor oil; alkyl sulfates such as sodium lauryl sulfate and ammonium lauryl sulfate; alkylbenzenesulfonates such as sodium dodecylbenzenesulfonate; alkylnaphthalenesulfonates; alkylphosphoric acid ester salts; naphthalenesulfonic acid-formalin condensate; and polyoxyethylene alkyl sulfuric acid ester salts. Additionally, examples of the nonionic surfactants may include: polyoxyethylene alkyl ethers, polyoxyethylene fatty acid esters, sorbitan fatty acid esters, polyoxyethylene alkylamines, glycerin, fatty acid esters and oxyethylene-oxypropylene block polymer. Further, examples of the cationic surfactants may include: alkylamine salts such as laurylamine acetate; and quaternary ammonium salts such as lauryltrimethylammonium chloride and stearyltrimethylammonium chloride. Additionally, examples of the amphoteric surfactants may include aminocarboxylic acid salts and alkylamino acids.

The above-described surfactants can each be used usually in a range from 0.01 to 10% by weight in relation to the polymerizable monomer. Such a surfactant affects the dispersion stability of the monomer, and also affects the environment dependence of the obtained polymerized toner particle. Such a surfactant is preferably used within the above-described range from the viewpoint of ensuring the dispersion stability of the monomer and reducing the environment dependence of the polymerized toner particle.

For the production of the polymerized toner particle, usually a polymerization initiator is used. Examples of the polymerization initiator include water-soluble polymerization initiators and oil-soluble polymerization initiators. In the present invention, either of a water-soluble polymerization initiator and an oil-soluble polymerization initiator can be used. Examples of the water-soluble polymerization initiator usable in the present invention may include: persulfates such as potassium persulfate and ammonium persulfate; and water-soluble peroxide compounds. Additionally, examples of the oil-soluble polymerization initiator usable in the present invention may include: azo compounds such as azobisisobutyronitrile; and oil-soluble peroxide compounds.

Additionally, for a case where a chain transfer agent is used in the present invention, examples of the chain transfer agent may include: mercaptans such as octylmercaptan, dodecylmercaptan and tert-dodecylmercaptan; and carbon tetrabromide.

Further, for a case where the polymerized toner particle used in the present invention contains a fixability improving agent, examples of the usable fixability improving agent include: natural waxes such as carnauba wax; and olefin waxes such as polypropylene wax and polyethylene wax.

Additionally, for a case where the polymerized toner particle used in the present invention contains a charge control agent, the charge control agent used is not particularly limited, and examples of the usable charge control agent include nigrosine dyes, quaternary ammonium salts, organometallic complexes and metal-containing monoazo dyes.

Additionally, examples of the external additives used for improving the fluidity and the like of the polymerized toner particle may include silica, titanium oxide, barium titanate, fluororesin fine particles and acrylic resin fine particles. These external additives can be used each alone or in combinations thereof.

Further, examples of the salting-out agent used for separation of the polymerized particles from the aqueous medium may include metal salts such as magnesium sulfate, aluminum sulfate, barium chloride, magnesium chloride, calcium chloride and sodium chloride.

The volume average particle size of the toner particle produced as described above falls in a range from 2 to 15 μm and preferably in a range from 3 to 10 μm, and the polymerized toner particle is higher in the particle uniformity than the pulverized toner particle. When the volume average particle size of the toner particle is smaller than 2 μm, the charging ability is degraded to tend to cause fogging or toner scattering; when larger than 15 μm, such a particle size offers a cause for image quality degradation.

Mixing of the carrier and the toner produced as described above can yield an electrophotographic developer. The mixing ratio between the carrier and the toner, namely, the toner concentration is preferably set at 3 to 15% by weight. When the toner concentration is less than 3% by weight, it is difficult to attain an intended image density; when the toner concentration exceeds 15% by weight, toner scattering or fogging tends to occur.

The electrophotographic developer according to the present invention can be used as a refill developer. In this case, the mixing ratio between the carrier and the toner, namely, the toner concentration is preferably set at 100 to 3000% by weight.

The electrophotographic developer according to the present invention, prepared as described above, can be used in a digital image formation apparatus, such as a copier, a printer, a FAX machine or a printing machine, adopting a development method in which an electrostatic latent image formed on a latent image holder having an organic photoconductor layer is reversely developed, while applying a bias electric field, with a magnetic brush of a two-component developer having a toner and a carrier. Additionally, the electrophotographic developer according to the present invention is also applicable to an image formation apparatus, such as a full-color machine, which adopts a method applying an alternating electric field composed of a DC bias and an AC bias superposed on the DC bias when a development bias is applied from the magnetic brush to the electrostatic latent image.

Hereinafter, the present invention is specifically described on the basis of Examples and others.

Example 1

Raw materials were weighed out in such a way that the amount of an Fe raw material is 7 mol in terms of Fe, the amount of a Mn raw material is 0.4 mol in terms of Mn, the amount of a Ti raw material is 0.15 mol in terms of Ti, and the amount of a Sr raw material is 0.04 mol in terms of Sr. To the weighed out raw materials, further a reducing agent (activated carbon) was added in a content of 0.5% by weight in relation to the total amount of the raw materials. The raw materials and the reducing agent were subjected to dry mixing for 10 minutes with a Henschel mixer to yield a raw material mixture. The obtained raw material mixture was converted into a pellet by using a roller compactor. Trimanganese tetraoxide was used as the Mn raw material, magnesium carbonate was used as the Mg raw material and strontium carbonate was used as the Sr raw material. The pelletized raw material mixture was calcined by using a rotary kiln. The calcination was performed at a calcination temperature of 1000° C. in an atmosphere having an oxygen concentration of 0.2% by weight.

Next, the obtained calcined substance was coarsely pulverized by using a rod mill, and then pulverized for 1 hour with a wet ball mill by using stainless steel beads of 3/16 inches in diameter to yield a slurry. The particle size (primary particle size of the pulverized substance) of the slurry thus obtained was measured with a Microtrac analyzer, and consequently the $D_{50}$ value was found to be 3.7 μm. An appropriate amount of a dispersant is added to the slurry; a dispersion obtained by dispersing $SiO_2$ having an average primary particle size of 12 nm in water in a proportion of 20% by weight in terms of solid content in relation to water, by using a homogenizer T65D Ultra-Turrax manufactured by IKA Works, Inc., was added to the slurry in an amount of 0.4% by weight in terms of the dispersion in relation to the weight of the calcined substance (raw material powder); additionally, for the purpose of ensuring the strength of the granulated particles and generating a reducing gas at the time of sintering, PVA (20% solution) as a binder was added to the slurry in an amount of 0.32% by weight in terms of the solid content of the binder in relation to the weight of the calcined substance (raw material powder); and then the thus treated slurry was granulated and dried with a spray dryer, and the obtained particles (granulated substance) were regulated in particle size.

The granulated substance obtained as described above was sintered for 16 hours with a tunnel electric furnace capable of performing atmospheric sintering to yield a sintered substance. The sintering was performed under the conditions that the temperature was set at 1000° C. and the oxygen concentration was set at 0% by volume by introducing nitrogen gas.

Then, the substance subjected to sintering was disintegrated and further classified for particle size regulation, and subjected to removal of low magnetic strength portions by magnetic separation to yield a core material composed of porous ferrite particles. The pore volume, the peak pore size and the saturation magnetization of the porous ferrite core material were found to be 0.0953 ml/g, 1.018 μm and 74 $Am^2/kg$, respectively.

Next, a filling resin solution was prepared by dissolving 100 parts by weight of the above-described porous ferrite particle, 12 parts by weight of a condensation-crosslinking silicone resin (SR-2411, manufactured by Dow Corning Toray Co., Ltd.) in terms of solid content and 2 parts by weight of γ-aminopropyltriethoxysilane in 1000 parts by weight of toluene. While the filling resin solution thus obtained was being mixed under stirring at 60° C. under a reduced pressure of 50 mmHg and the toluene was being evaporated, the resin was impregnated and filled in the interior of the porous ferrite core material.

After making sure of the sufficient evaporation of the toluene, the mixture was further continuously stirred for 30 minutes to remove the toluene almost completely. Thereafter, the mixture was taken out from the filling apparatus and transferred into a vessel, and the vessel was placed in a hot air heating oven to perform a heat treatment at 220° C. for 2 hours.

Thereafter, cooling down to room temperature was conducted and the ferrite particles with the cured resin therein were taken out, subjected to disintegration of the particle aggregation with a vibration sieve of 200M in mesh opening size and subjected to removal of nonmagnetic substances with a magnetic separator. Thereafter, coarse particles were removed again with a vibration sieve to yield particles filled with a resin, namely, a resin-filled ferrite carrier.

Example 2

The mixing amount of Mg was set at 0.1 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 3

The mixing amount of Mg was set at 0.7 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 4

The mixing amount of Ti was set at 0.07 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 8% by weight in terms of solid content in relation to 100% by weight of the core material.

Example 5

The mixing amount of Ti was set at 0.3 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Example 6

Sr was not mixed, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 7

The mixing amount of Sr was set at 0.14 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 8

The pulverization time with a wet ball mill was set at 2 hours and the slurry particle size of the granulated particles was set at 3.2 μm, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 8% by weight in terms of solid content in relation to 100% by weight of the core material.

Example 9

The pulverization time with a wet ball mill was set at 30 minutes and the slurry particle size of the granulated particles was set at 5 μm, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Example 10

The addition amount of PVA used in the granulation was set at 0.16% by weight in relation to the weight of the calcined substance (raw material powder), and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 11

The addition amount of PVA used in the granulation was set at 1.92% by weight in relation to the weight of the calcined substance (raw material powder), and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 12

The sintering temperature was set at 1050° C., and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 8% by weight in terms of solid content in relation to 100% by weight of the core material.

Example 13

A high-purity $Fe_2O_3$ raw material was used, Mn and $SiO_2$ were not added at the time of the granulation and the sintering temperature was set at 950° C., and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Example 14

In the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Next, a surface-coating resin solution was prepared by diluting with 10 parts by weight of toluene 1 part by weight of a condensation-crosslinking silicone resin (SR-2411, manufactured by Dow Corning Toray Co., Ltd.) in terms of solid content; 100 parts by weight of the obtained resin-filled ferrite carrier was subjected to a surface resin coating by using the surface-coating resin solution with a universal mixing stirrer. After the completion of the surface resin coating, the thus treated ferrite carrier was placed in a vessel, and the vessel was placed in a hot air heating oven to conduct a heat treatment at 220° C. for 2 hours.

Thereafter, cooling down to room temperature was conducted and the ferrite particles with the cured resin thereon were taken out, subjected to disintegration of the particle aggregation with a vibration sieve of 200M in mesh opening size and subjected to removal of nonmagnetic substances with a magnetic separator. Thereafter, coarse particles were removed again with a vibration sieve to yield a resin-filled ferrite carrier the surface of which was coated with a resin.

Example 15

The oxygen concentration in the sintering was set at 1.5% by volume, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 16

The calcination temperature was set at 800° C., and otherwise in the same manner as in Example 1, a porous ferrite core material was obtained. In the same manner as in Example 1, a resin-filled ferrite carrier was obtained by filling a condensation-crosslinking silicone resin in the thus obtained porous core material so as for the content of the condensation-crosslinking silicone resin to be 12% by weight in terms of solid content in relation to 100% by weight of the core material.

Example 17

The calcination temperature was set at 1100° C., and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 8% by weight in terms of solid content in relation to 100% by weight of the core material.

Example 18

The oxygen concentration in the calcination was set at 1.5% by volume, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 19

The oxygen concentration in the calcination was set at 0% by volume, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Example 20

A porous ferrite core material was subjected to a surface oxidation treatment at 200° C. with a rotary electric furnace, and otherwise in the same manner as in Example 1, a porous ferrite core material was obtained. In the same manner as in Example 1, a resin-filled ferrite carrier was obtained by filling a condensation-crosslinking silicone resin in the obtained core material so as for the content of the condensation-crosslinking silicone resin to be 12% by weight in terms of solid content in relation to 100% by weight of the core material.

Example 21

A porous ferrite core material was subjected to a surface oxidation treatment at 400° C. with a rotary electric furnace, and otherwise in the same manner as in Example 1, a porous ferrite core material was obtained. In the same manner as in Example 1, a resin-filled ferrite carrier was obtained by filling a condensation-crosslinking silicone resin in the obtained core material so as for the content of the condensation-crosslinking silicone resin to be 12% by weight in terms of solid content in relation to 100% by weight of the core material.

Comparative Example 1

The mixing amounts of Mg and Sr were set at 0.8 mol and 0.18 mol, respectively, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Comparative Example 2

Mg was not mixed, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Comparative Example 3

The mixing amount of Mg was set at 2.5 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a condensation-crosslinking silicone resin was filled in the thus surface treated core material so as for the content of the condensation-crosslinking silicone resin to be 8% by weight in terms of solid content in relation to 100% by weight of the core material. However, resin powder was generated during filling, and hence no resin-filled ferrite carrier was obtained.

Comparative Example 4

Ti was not mixed, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a condensation-crosslinking silicone resin was filled in the thus surface treated core material so as for the content of the condensation-crosslinking silicone resin to be 12% by weight in terms of solid content in relation to 100% by weight of the core material. However, the carrier particles vigorously aggregated with each other during filling, and hence no resin-filled ferrite carrier was obtained.

Comparative Example 5

The mixing amount of Ti was set at 0.7 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Comparative Example 6

The mixing amount of Sr was set at 0.36 mol, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Comparative Example 7

The pulverization with a wet ball mill was performed for 1 hour and further performed with zirconia beads of 1/40 inch in grain size for 2 hours, and thus the slurry particle size was set at 1.1 μm, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a condensation-crosslinking silicone resin was filled in the thus surface treated core material so as for the content of the condensation-crosslinking silicone resin to be 8% by weight in terms of solid content in relation to 100% by weight of the core material. However, the carrier particles vigorously aggregated with each other during filling, and hence no resin-filled ferrite carrier was obtained.

Comparative Example 8

The time of the pulverization with a wet ball mill was set at 15 minutes and the slurry particle size in the granulation was set at 8 μm, and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Comparative Example 9

The addition amount of PVA used in the granulation was set at 0.04% by weight in relation to the weight of the calcined substance (raw material powder), and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Comparative Example 10

The addition amount of PVA used in the granulation was set at 4.8% by weight in relation to the weight of the calcined substance (raw material powder), and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Comparative Example 11

The oxygen concentration in the sintering was set at 21% by volume (in the air), and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Comparative Example 12

The oxygen concentration in the calcination was set at 21% by volume (in the air), and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 12% by weight in terms of solid content in relation to 100% by weight of the core material.

Comparative Example 13

The sintering temperature was set at 1150° C., and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a condensation-crosslinking silicone resin was filled in the thus surface treated core material so as for the content of the condensation-crosslinking silicone resin to be 8% by weight in terms of solid content in relation to 100% by weight of the core material. However, the carrier particles vigorously aggregated with each other during filling, and hence no resin-filled ferrite carrier was obtained.

Comparative Example 14

The sintering temperature was set at 800° C., and otherwise in the same manner as in Example 1, a porous ferrite core material was obtained. The obtained core material was subjected to a surface oxidation treatment under the conditions of a surface oxidation treatment temperature of 200° C. and air atmosphere with a rotary electric furnace. In the same manner as in Example 1, a resin-filled ferrite carrier was obtained by filling a condensation-crosslinking silicone resin in the thus surface treated core material so as for the content of the condensation-crosslinking silicone resin to be 16% by weight in terms of solid content in relation to 100% by weight of the core material.

Comparative Example 15

A porous ferrite core material was subjected to a surface oxidation treatment at 550° C. with a rotary electric furnace, and otherwise in the same manner as in Example 1, a porous ferrite core material was obtained. In the same manner as in Example 1, a resin-filled ferrite carrier was obtained by filling a condensation-crosslinking silicone resin in the thus obtained core material so as for the content of the condensation-crosslinking silicone resin to be 12% by weight in terms of solid content in relation to 100% by weight of the core material.

For each of Examples 1 to 21 and Comparative Examples 1 to 15, Table 1 shows the raw material mixing amounts and the calcination conditions (calcination temperature and oxygen concentration), Table 2 shows the granulation conditions and the sintering conditions, and Table 3 shows the crystal structure of the porous ferrite core material before the surface oxidation treatment. For each of Examples 1 to 21 and Comparative Examples 1 to 15, Table 4 shows the chemical composition (ICP) of the porous ferrite core material, and Table 5 shows the surface oxidation treatment temperature, the magnetic properties (saturation magnetization, remanent magnetization and coercive force) of the porous ferrite core material before and after the surface oxidation treatment, the pore volume and the peak pore size. Additionally, for each of Examples 1 to 21 and Comparative Examples 1 to 15, Table 6 shows the filling conditions (filling resin, filling amount, addition amount of γ-aminopropyltriethoxysilane and curing temperature) and the surface coating conditions (surface coating resin, coating amount and curing temperature), and Table 7 shows the apparent density, the true density, the magnetic properties (saturation magnetization, remanent magnetization and coercive force), the volume average particle size, the charge amount, the resistance (250 V, 6.5-mm gap) and the shape factor SF-1 of the resin-filled ferrite carrier. It is to be noted that the following were measured with the above-described methods: the crystal structure, the chemical composition (ICP), the saturation magnetization, the pore volume and the peak pore size of the porous ferrite core material; and the apparent density, the true density, the magnetic properties (saturation magnetization, remanent magnetization and coercive force), the volume average particle size, the resistance (250 V, 6.5-mm gap) and the shape factor SF-1 of the resin-filled ferrite carrier. The charge amount was measured according to the following method.

(Charge Amount)

A developer, having a toner concentration of 10% by weight, for the charge amount measurement was obtained as follows: 45 g of a carrier and 5 g of a toner were weighed out and placed in a 50-cc glass bottle, and were mixed together under stirring with a ball mill at a rotation number of 100 rpm for 30 minutes to yield the concerned developer. The charge amount of the obtained developer was measured with a charge amount measurement apparatus q/m-meter manufactured by Epping GmbH.

TABLE 1

| | Raw material mixing amounts | | | | | Calcination conditions | |
|---|---|---|---|---|---|---|---|
| | Fe (mol) | Mg (mol) | Ti (mol) | Sr (mol) | Reducing agent (activated carbon) (wt %) | Calcination temperature (° C.) | Oxygen concentration (vol %) |
| Example 1 | 7 | 0.4 | 0.15 | 0.04 | 0.5 | 1000 | 0.2 |
| Example 2 | 7 | 0.1 | 0.15 | 0.04 | 0.5 | 1000 | 0.2 |
| Example 3 | 7 | 0.7 | 0.15 | 0.04 | 0.5 | 1000 | 0.2 |
| Example 4 | 7 | 0.4 | 0.07 | 0.04 | 0.5 | 1000 | 0.2 |
| Example 5 | 7 | 0.4 | 0.3 | 0.04 | 0.5 | 1000 | 0.2 |
| Example 6 | 7 | 0.4 | 0.15 | 0 | 0.5 | 1000 | 0.2 |
| Example 7 | 7 | 0.4 | 0.15 | 0.14 | 0.5 | 1000 | 0.2 |
| Example 8 | 7 | 0.4 | 0.15 | 0.04 | 0.5 | 1000 | 0.2 |
| Example 9 | 7 | 0.4 | 0.15 | 0.04 | 0.5 | 1000 | 0.2 |

TABLE 1-continued

| | Raw material mixing amounts | | | | | Calcination conditions | |
|---|---|---|---|---|---|---|---|
| | Fe (mol) | Mg (mol) | Ti (mol) | Sr (mol) | Reducing agent (activated carbon) (wt %) | Calcination temperature (° C.) | Oxygen concentration (vol %) |
| Example 10 | 7 | 0.4 | 0.15 | 0.04 | 0.5 | 1000 | 0.2 |
| Example 11 | 7 | 0.4 | 0.15 | 0.04 | 0.5 | 1000 | 0.2 |
| Example 12 | 7 | 0.4 | 0.15 | 0.04 | 0.5 | 1000 | 0.2 |
| Example 13 | 7 | 0.4 | 0.15 | 0.04 | 0.5 | 1000 | 0.2 |
| Example 14 | 7 | 0.4 | 0.15 | 0.04 | 0.5 | 1000 | 0.2 |
| Example 15 | 7 | 0.4 | 0.15 | 0.04 | 0.5 | 1000 | 0.2 |
| Example 16 | 7 | 0.4 | 0.15 | 0.04 | 0.5 | 800 | 0.2 |
| Example 17 | 7 | 0.4 | 0.15 | 0.04 | 0.5 | 1100 | 0.2 |
| Example 18 | 7 | 0.4 | 0.15 | 0.04 | 0.5 | 1000 | 1.5 |
| Example 19 | 7 | 0.4 | 0.15 | 0.04 | 0.5 | 1000 | 0 |
| Example 20 | 7 | 0.4 | 0.15 | 0.04 | 0.5 | 1000 | 0.2 |
| Example 21 | 7 | 0.4 | 0.15 | 0.04 | 0.5 | 1000 | 0.2 |
| Comparative Example 1 | 7 | 0.8 | 0.15 | 0.18 | 0.5 | 1000 | 0.2 |
| Comparative Example 2 | 7 | 0 | 0.15 | 0.04 | 0.5 | 1000 | 0.2 |
| Comparative Example 3 | 7 | 2.5 | 0.15 | 0.04 | 0.5 | 1000 | 0.2 |
| Comparative Example 4 | 7 | 0.4 | 0 | 0.04 | 0.5 | 1000 | 0.2 |
| Comparative Example 5 | 7 | 0.4 | 0.7 | 0.04 | 0.5 | 1000 | 0.2 |
| Comparative Example 6 | 7 | 0.4 | 0.15 | 0.36 | 0.5 | 1000 | 0.2 |
| Comparative Example 7 | 7 | 0.4 | 0.15 | 0.04 | 0.5 | 1000 | 0.2 |
| Comparative Example 8 | 7 | 0.4 | 0.15 | 0.04 | 0.5 | 1000 | 0.2 |
| Comparative Example 9 | 7 | 0.4 | 0.15 | 0.04 | 0.5 | 1000 | 0.2 |
| Comparative Example 10 | 7 | 0.4 | 0.15 | 0.04 | 0.5 | 1000 | 0.2 |
| Comparative Example 11 | 7 | 0.4 | 0.15 | 0.04 | 0.5 | 1000 | 21 |
| Comparative Example 12 | 7 | 0.4 | 0.15 | 0.04 | 0.5 | 1000 | 0.2 |
| Comparative Example 13 | 7 | 0.4 | 0.15 | 0.04 | 0.5 | 1000 | 0.2 |
| Comparative Example 14 | 7 | 0.4 | 0.15 | 0.04 | 0.5 | 1000 | 0.2 |
| Comparative Example 15 | 7 | 0.4 | 0.15 | 0.04 | 0.5 | 1000 | 0.2 |

TABLE 2

| | Granulation | | | Sintering conditions | |
|---|---|---|---|---|---|
| | Slurry particle size (μm) | Addition amount of $SiO_2$ dispersion (wt %) *1 | Addition amount of binder (wt %) *2 | Sintering temperature (° C.) | Oxygen concentration (vol %) |
| Example 1 | 3.7 | 0.4 | 0.32 | 1000 | 0 |
| Example 2 | 3.7 | 0.4 | 0.32 | 1000 | 0 |
| Example 3 | 3.7 | 0.4 | 0.32 | 1000 | 0 |
| Example 4 | 3.7 | 0.4 | 0.32 | 1000 | 0 |
| Example 5 | 3.7 | 0.4 | 0.32 | 1000 | 0 |
| Example 6 | 3.7 | 0.4 | 0.32 | 1000 | 0 |
| Example 7 | 3.7 | 0.4 | 0.32 | 1000 | 0 |
| Example 8 | 3.2 | 0.4 | 0.32 | 1000 | 0 |
| Example 9 | 5 | 0.4 | 0.32 | 1000 | 0 |
| Example 10 | 3.7 | 0.4 | 0.16 | 1000 | 0 |
| Example 11 | 3.7 | 0.4 | 1.92 | 1000 | 0 |
| Example 12 | 3.7 | 0.4 | 0.32 | 1050 | 0 |
| Example 13 | 3.7 | — | 0.32 | 950 | 0 |
| Example 14 | 3.7 | 0.4 | 0.32 | 1000 | 0 |

TABLE 2-continued

| | Granulation | | | Sintering conditions | |
|---|---|---|---|---|---|
| | Slurry particle size (μm) | Addition amount of $SiO_2$ dispersion (wt %) *1 | Addition amount of binder (wt %) *2 | Sintering temperature (° C.) | Oxygen concentration (vol %) |
| Example 15 | 3.7 | 0.4 | 0.32 | 1000 | 1.5 |
| Example 16 | 3.7 | 0.4 | 0.32 | 1000 | 0 |
| Example 17 | 3.7 | 0.4 | 0.32 | 1000 | 0 |
| Example 18 | 3.7 | 0.4 | 0.32 | 1000 | 0 |
| Example 19 | 3.7 | 0.4 | 0.32 | 1000 | 0 |
| Example 20 | 3.7 | 0.4 | 0.32 | 1000 | 0 |
| Example 21 | 3.7 | 0.4 | 0.32 | 1000 | 0 |
| Comparative Example 1 | 3.7 | 0.4 | 0.32 | 1000 | 0 |
| Comparative Example 2 | 3.7 | 0.4 | 0.32 | 1000 | 0 |
| Comparative Example 3 | 3.7 | 0.4 | 0.32 | 1000 | 0 |
| Comparative Example 4 | 3.7 | 0.4 | 0.32 | 1000 | 0 |
| Comparative Example 5 | 3.7 | 0.4 | 0.32 | 1000 | 0 |
| Comparative Example 6 | 3.7 | 0.4 | 0.32 | 1000 | 0 |
| Comparative Example 7 | 1.1 | 0.4 | 0.32 | 1000 | 0 |
| Comparative Example 8 | 8 | 0.4 | 0.32 | 1000 | 0 |
| Comparative Example 9 | 3.7 | 0.4 | 0.04 | 1000 | 0 |
| Comparative Example 10 | 3.7 | 0.4 | 4.8 | 1000 | 0 |
| Comparative Example 11 | 3.7 | 0.4 | 0.32 | 1000 | 21 |
| Comparative Example 12 | 3.7 | 0.4 | 0.32 | 1000 | 0 |
| Comparative Example 13 | 3.7 | 0.4 | 0.32 | 1150 | 0 |
| Comparative Example 14 | 3.7 | 0.4 | 0.32 | 800 | 0 |
| Comparative Example 15 | 3.7 | 0.4 | 0.32 | 1000 | 0 |

*1: The addition amount of the $SiO_2$ dispersion is the weight of the dispersion in relation to the weight of the raw material powder.
*2: The addition amount of the binder is the weight of the solid content in relation to the weight of the raw material powder.

TABLE 3

| | Crystal structures | | | | | | |
|---|---|---|---|---|---|---|---|
| | Spinel phase | $Fe_2O_3$ | FeO | $MgTiO_3$ and/or $Mg_2TiO_4$ | $SrTiO_3$ | $Sr_2Fe_2O_5$ | Sr-Ferrite |
| Example 1 | ○ | Δ | x | Δ | Δ | Δ | x |
| Example 2 | ○ | Δ | x | Δ | Δ | Δ | x |
| Example 3 | ○ | Δ | x | ○ | Δ | Δ | x |
| Example 4 | ○ | Δ | x | Δ | Δ | ○ | x |
| Example 5 | ○ | Δ | x | Δ | ○ | Δ | x |
| Example 6 | ○ | Δ | x | Δ | x | x | x |
| Example 7 | ○ | Δ | x | Δ | Δ | Δ | Δ |
| Example 8 | ○ | Δ | x | Δ | Δ | Δ | x |
| Example 9 | ○ | Δ | x | Δ | Δ | Δ | x |
| Example 10 | ○ | ○ | x | Δ | Δ | Δ | x |
| Example 11 | ○ | x | Δ | Δ | Δ | Δ | x |
| Example 12 | ○ | Δ | x | Δ | Δ | Δ | x |
| Example 13 | ○ | Δ | x | Δ | Δ | Δ | x |
| Example 14 | ○ | Δ | x | Δ | Δ | Δ | x |
| Example 15 | ○ | Δ | x | Δ | Δ | x | Δ |
| Example 16 | ○ | Δ | x | Δ | x | Δ | x |
| Example 17 | ○ | Δ | x | Δ | Δ | Δ | x |
| Example 18 | ○ | Δ | x | Δ | Δ | Δ | x |
| Example 19 | ○ | x | x | Δ | Δ | Δ | x |

TABLE 3-continued

| | Crystal structures | | | | | | |
|---|---|---|---|---|---|---|---|
| | Spinel phase | $Fe_2O_3$ | FeO | $MgTiO_3$ and/or $Mg_2TiO_4$ | $SrTiO_3$ | $Sr_2Fe_2O_5$ | Sr-Ferrite |
| Example 20 | ○ | Δ | x | Δ | Δ | Δ | x |
| Example 21 | ○ | Δ | x | Δ | Δ | Δ | x |
| Comparative Example 1 | ○ | Δ | x | ○ | Δ | ○ | x |
| Comparative Example 2 | ○ | Δ | x | x | Δ | Δ | x |
| Comparative Example 3 | ○ | Δ | x | ○ | Δ | Δ | x |
| Comparative Example 4 | ○ | Δ | x | x | x | Δ | x |
| Comparative Example 5 | ○ | Δ | x | Δ | ○ | Δ | x |
| Comparative Example 6 | ○ | Δ | x | Δ | ○ | ○ | ○ |
| Comparative Example 7 | ○ | Δ | x | Δ | Δ | Δ | x |
| Comparative Example 8 | ○ | x | ○ | Δ | Δ | Δ | x |
| Comparative Example 9 | ○ | ○ | x | ○ | ○ | ○ | x |
| Comparative Example 10 | ○ | x | ○ | Δ | Δ | Δ | x |
| Comparative Example 11 | ○ | ○ | x | Δ | Δ | x | ○ |
| Comparative Example 12 | ○ | Δ | x | Δ | Δ | Δ | Δ |
| Comparative Example 13 | ○ | Δ | x | Δ | Δ | Δ | x |
| Comparative Example 14 | ○ | Δ | x | x | x | Δ | x |
| Comparative Example 15 | ○ | Δ | x | Δ | Δ | Δ | x |

○: Presence can be identified.
Δ: Presence can be barely identified (3 wt % or less).
x: Absent (undetectable)

TABLE 4

| | Chemical analysis (ICP) | | | | | |
|---|---|---|---|---|---|---|
| | Fe (wt %) | Mg (wt %) | Ti (wt %) | Sr (wt %) | Mn (wt %) | Si (wt %) |
| Example 1 | 68.2 | 1.69 | 1.25 | 0.61 | 0.71 | 411 |
| Example 2 | 69.9 | 0.43 | 1.28 | 0.62 | 0.73 | 533 |
| Example 3 | 66.6 | 2.89 | 1.22 | 0.59 | 0.63 | 445 |
| Example 4 | 68.2 | 1.71 | 0.59 | 0.62 | 0.72 | 488 |
| Example 5 | 67 | 1.67 | 2.46 | 0.6 | 0.7 | 467 |
| Example 6 | 68.5 | 1.71 | 1.27 | 0 | 0.71 | 556 |
| Example 7 | 67.1 | 1.67 | 1.23 | 2.1 | 0.68 | 522 |
| Example 8 | 68.4 | 1.71 | 1.24 | 0.61 | 0.7 | 484 |
| Example 9 | 68.1 | 1.7 | 1.25 | 0.62 | 0.71 | 478 |
| Example 10 | 68.6 | 1.72 | 1.24 | 0.6 | 0.72 | 409 |
| Example 11 | 68.3 | 1.68 | 1.26 | 0.6 | 0.67 | 391 |
| Example 12 | 68.4 | 1.69 | 1.23 | 0.62 | 0.69 | 403 |
| Example 13 | 68.1 | 1.7 | 1.27 | 0.61 | 0.02 | 28 |
| Example 14 | 68.2 | 1.69 | 1.25 | 0.61 | 0.71 | 411 |
| Example 15 | 68.2 | 1.68 | 1.25 | 0.61 | 0.72 | 487 |
| Example 16 | 68 | 1.72 | 1.26 | 0.62 | 0.71 | 436 |
| Example 17 | 68.5 | 1.61 | 1.24 | 0.63 | 0.7 | 462 |
| Example 18 | 68.1 | 1.6 | 1.24 | 0.59 | 0.68 | 494 |
| Example 19 | 68.5 | 1.63 | 1.25 | 0.6 | 0.69 | 509 |
| Example 20 | 68.2 | 1.69 | 1.25 | 0.61 | 0.71 | 411 |
| Example 21 | 68.2 | 1.69 | 1.25 | 0.61 | 0.71 | 411 |
| Comparative Example 1 | 61.5 | 3.08 | 3.79 | 2.5 | 0.62 | 490 |
| Comparative Example 2 | 70.5 | 0 | 1.29 | 0.63 | 0.73 | 586 |
| Comparative Example 3 | 58.4 | 9.08 | 1.07 | 0.52 | 0.71 | 569 |
| Comparative Example 4 | 69.5 | 1.72 | 0 | 0.62 | 0.69 | 572 |

TABLE 4-continued

| | Chemical analysis (ICP) | | | | | |
|---|---|---|---|---|---|---|
| | Fe (wt %) | Mg (wt %) | Ti (wt %) | Sr (wt %) | Mn (wt %) | Si (wt %) |
| Comparative Example 5 | 63.9 | 1.59 | 5.48 | 0.57 | 0.7 | 474 |
| Comparative Example 6 | 64.4 | 1.62 | 1.18 | 5.19 | 0.72 | 460 |
| Comparative Example 7 | 68.2 | 1.64 | 1.25 | 0.61 | 0.71 | 530 |
| Comparative Example 8 | 68.4 | 1.6 | 1.24 | 0.62 | 0.7 | 431 |
| Comparative Example 9 | 68.5 | 1.59 | 1.27 | 0.61 | 0.68 | 473 |
| Comparative Example 10 | 68.1 | 1.58 | 1.23 | 0.62 | 0.65 | 485 |
| Comparative Example 11 | 68.3 | 1.62 | 1.25 | 0.63 | 0.69 | 508 |
| Comparative Example 12 | 68.5 | 1.64 | 1.26 | 0.62 | 0.72 | 527 |
| Comparative Example 13 | 68.2 | 1.66 | 1.25 | 0.61 | 0.73 | 494 |
| Comparative Example 14 | 68.1 | 1.65 | 1.23 | 0.6 | 0.7 | 512 |
| Comparative Example 15 | 68.2 | 1.69 | 1.25 | 0.61 | 0.71 | 411 |

TABLE 5

| | Magnetic properties before surface oxidation treatment (B—H, 3 kOe) | | | Surface oxidation treatment temperature (° C.) | Magnetic properties after surface oxidation treatment (B—H, 3 kOe) | | | Mercury porosimetry | |
|---|---|---|---|---|---|---|---|---|---|
| | Saturation magnetization ($Am^2/kg$) | Remanent magnetization ($Am^2/kg$) | Coercive force (A/m) | | Saturation magnetization ($Am^2/kg$) | Remanent magnetization ($Am^2/kg$) | Coercive force (A/m) | Pore volume (ml/g) | Peak pore size (μm) |
| Example 1 | 74 | 4 | 24 | — | — | — | — | 0.0953 | 1.018 |
| Example 2 | 80 | 2 | 18 | 200 | 76 | 4 | 42 | 0.1018 | 1.022 |
| Example 3 | 68 | 3 | 18 | 200 | 64 | 6 | 36 | 0.0872 | 1.002 |
| Example 4 | 79 | 3 | 18 | 200 | 75 | 5 | 30 | 0.0669 | 0.735 |
| Example 5 | 63 | 4 | 24 | 200 | 63 | 5 | 36 | 0.1281 | 1.289 |
| Example 6 | 75 | 3 | 18 | 200 | 71 | 4 | 24 | 0.0894 | 0.985 |
| Example 7 | 71 | 4 | 24 | 200 | 67 | 6 | 36 | 0.0998 | 1.039 |
| Example 8 | 74 | 4 | 24 | 200 | 70 | 5 | 30 | 0.0623 | 0.568 |
| Example 9 | 73 | 3 | 24 | 200 | 69 | 5 | 30 | 0.1362 | 1.439 |
| Example 10 | 59 | 3 | 24 | 200 | 55 | 5 | 36 | 0.0867 | 1.223 |
| Example 11 | 61 | 4 | 24 | 200 | 57 | 5 | 36 | 0.1062 | 0.869 |
| Example 12 | 74 | 3 | 18 | 200 | 70 | 4 | 24 | 0.0516 | 1.011 |
| Example 13 | 72 | 4 | 24 | 200 | 62 | 6 | 36 | 0.1395 | 1.026 |
| Example 14 | 78 | 3 | 18 | 200 | 74 | 5 | 30 | 0.0962 | 1.007 |
| Example 15 | 65 | 4 | 24 | 200 | 61 | 6 | 36 | 0.0944 | 1.034 |
| Example 16 | 51 | 5 | 30 | 200 | 47 | 6 | 42 | 0.0992 | 0.872 |
| Example 17 | 78 | 2 | 18 | 200 | 74 | 4 | 24 | 0.0559 | 0.562 |
| Example 18 | 78 | 2 | 18 | 200 | 74 | 4 | 24 | 0.0942 | 1.044 |
| Example 19 | 63 | 4 | 30 | 200 | 59 | 5 | 36 | 0.0963 | 1.037 |
| Example 20 | 74 | 4 | 24 | 200 | 70 | 5 | 30 | 0.0969 | 0.976 |
| Example 21 | 74 | 4 | 24 | 400 | 42 | 6 | 42 | 0.0985 | 0.965 |
| Comparative Example 1 | 38 | 4 | 30 | 200 | 34 | 5 | 40 | 0.1251 | 0.865 |
| Comparative Example 2 | 82 | 6 | 44 | 200 | 78 | 7 | 60 | 0.1101 | 1.054 |
| Comparative Example 3 | 39 | 4 | 44 | 200 | 35 | 5 | 48 | 0.0776 | 0.977 |
| Comparative Example 4 | 85 | 6 | 44 | 200 | 81 | 7 | 48 | 0.0923 | 0.343 |
| Comparative Example 5 | 36 | 5 | 30 | 200 | 32 | 6 | 36 | 0.1959 | 0.422 |
| Comparative Example 6 | 66 | 8 | 80 | 200 | 62 | 12 | 96 | 0.1161 | 0.392 |
| Comparative Example 7 | 75 | 3 | 18 | 200 | 71 | 4 | 24 | 0.0381 | 0.325 |
| Comparative Example 8 | 76 | 3 | 24 | 200 | 72 | 5 | 40 | 0.1429 | 1.628 |
| Comparative Example 9 | 37 | 6 | 72 | 200 | 34 | 7 | 84 | 0.0752 | 0.912 |
| Comparative Example 10 | 39 | 7 | 82 | 200 | 35 | 8 | 90 | 0.1587 | 1.142 |
| Comparative Example 11 | 25 | 12 | 96 | 200 | 21 | 15 | 120 | 0.0932 | 1.077 |
| Comparative Example 12 | 18 | 10 | 96 | 200 | 16 | 14 | 108 | 0.0929 | 1.056 |
| Comparative Example 13 | 77 | 4 | 24 | 200 | 73 | 5 | 30 | 0.0398 | 0.339 |
| Comparative Example 14 | 38 | 8 | 82 | 200 | 24 | 12 | 108 | 0.1872 | 0.456 |
| Comparative Example 15 | 30 | 14 | 128 | 550 | 30 | 16 | 148 | 0.0995 | 0.955 |

TABLE 6

| | Filling conditions | | | | Surface coating conditions | | |
|---|---|---|---|---|---|---|---|
| | Filling resin | Filling amount (wt %) *3 | γ-Aminopropyl-triethoxysilane (wt %) *4 | Curing temperature (° C.) | Surface coating resin | Coating amount (wt %) *5 | Curing temperature (° C.) |
| Example 1 | Silicone resin | 12 | 2 | 220 | | — | |
| Example 2 | Silicone resin | 12 | 2 | 220 | | — | |
| Example 3 | Silicone resin | 12 | 2 | 220 | | — | |
| Example 4 | Silicone resin | 8 | 2 | 220 | | — | |
| Example 5 | Silicone resin | 16 | 2 | 220 | | — | |
| Example 6 | Silicone resin | 12 | 2 | 220 | | — | |
| Example 7 | Silicone resin | 12 | 2 | 220 | | — | |

TABLE 6-continued

| | Filling conditions | | | | Surface coating conditions | | |
|---|---|---|---|---|---|---|---|
| | Filling resin | Filling amount (wt %) *3 | γ-Aminopropyl-triethoxysilane (wt %) *4 | Curing temperature (° C.) | Surface coating resin | Coating amount (wt %) *5 | Curing temperature (° C.) |
| Example 8 | Silicone resin | 8 | 2 | 220 | | — | |
| Example 9 | Silicone resin | 16 | 2 | 220 | | — | |
| Example 10 | Silicone resin | 12 | 2 | 220 | | — | |
| Example 11 | Silicone resin | 12 | 2 | 220 | | — | |
| Example 12 | Silicone resin | 8 | 2 | 220 | | — | |
| Example 13 | Silicone resin | 16 | 2 | 220 | | — | |
| Example 14 | Silicone resin | 12 | 2 | 220 | Silicone resin | 1 | 220 |
| Example 15 | Silicone resin | 12 | 2 | 220 | | — | |
| Example 16 | Silicone resin | 12 | 2 | 220 | | — | |
| Example 17 | Silicone resin | 8 | 2 | 220 | | — | |
| Example 18 | Silicone resin | 12 | 2 | 220 | | — | |
| Example 19 | Silicone resin | 12 | 2 | 220 | | — | |
| Example 20 | Silicone resin | 12 | 2 | 220 | | — | |
| Example 21 | Silicone resin | 12 | 2 | 220 | | — | |
| Comparative Example 1 | Silicone resin | 16 | 2 | 220 | | — | |
| Comparative Example 2 | Silicone resin | 12 | 2 | 220 | | — | |
| Comparative Example 3 | Silicone resin | 8 | 2 | 220 | | — | |
| Comparative Example 4 | Silicone resin | 12 | 2 | 220 | | — | |
| Comparative Example 5 | Silicone resin | 16 | 2 | 220 | | — | |
| Comparative Example 6 | Silicone resin | 12 | 2 | 220 | | — | |
| Comparative Example 7 | Silicone resin | 8 | 2 | 220 | | — | |
| Comparative Example 8 | Silicone resin | 16 | 2 | 220 | | — | |
| Comparative Example 9 | Silicone resin | 12 | 2 | 220 | | — | |
| Comparative Example 10 | Silicone resin | 16 | 2 | 220 | | — | |
| Comparative Example 11 | Silicone resin | 12 | 2 | 220 | | — | |
| Comparative Example 12 | Silicone resin | 12 | 2 | 220 | | — | |
| Comparative Example 13 | Silicone resin | 8 | 2 | 220 | | — | |
| Comparative Example 14 | Silicone resin | 16 | 2 | 220 | | — | |
| Comparative Example 15 | Silicone resin | 12 | 2 | 220 | | — | |

*3: The addition amount of the filling resin in terms of the solid content in relation to the weight of the core material

*4: The addition amount in relation to the solid content of the filling resin

*5: The addition amount of the surface coating resin in terms of the solid content in relation to the weight of the carrier after the resin filling

TABLE 7

| | Values of properties | | | | | | | | |
|---|---|---|---|---|---|---|---|---|---|
| | | | Magnetic properties after resin filling (B—H, 3 kOe) | | | Volume average | | Resistance | |
| | Apparent density ($g/cm^3$) | True density ($g/cm^3$) | Saturation magnetization ($Am^2/kg$) | Remanent magnetization ($Am^2/kg$) | Coercive force (A/m) | particle size (μm) | Charge amount (μc/g) | (250 V, 6.5-mm Gap) (Ω) | SF-1 |
| Example 1 | 1.77 | 3.93 | 66 | 5 | 30 | 36.21 | 40.25 | $1.8 \times 10^8$ | 106 |
| Example 2 | 1.66 | 3.96 | 71 | 5 | 48 | 37.09 | 30.27 | $8.6 \times 10^6$ | 110 |
| Example 3 | 1.94 | 3.92 | 61 | 7 | 42 | 37.22 | 41.22 | $5.2 \times 10^8$ | 105 |
| Example 4 | 2.04 | 4.09 | 73 | 6 | 36 | 36.72 | 25.42 | $6.6 \times 10^6$ | 112 |
| Example 5 | 1.43 | 3.82 | 54 | 6 | 42 | 36.89 | 42.31 | $8.5 \times 10^8$ | 106 |
| Example 6 | 1.89 | 3.95 | 67 | 5 | 30 | 37.03 | 29.81 | $3.3 \times 10^8$ | 104 |
| Example 7 | 1.69 | 3.98 | 63 | 7 | 42 | 37.73 | 41.27 | $7.7 \times 10^7$ | 111 |
| Example 8 | 2.12 | 4.08 | 69 | 6 | 36 | 37.22 | 22.31 | $8.5 \times 10^6$ | 113 |
| Example 9 | 1.42 | 3.79 | 63 | 6 | 36 | 37.65 | 48.38 | $2.5 \times 10^7$ | 106 |
| Example 10 | 1.95 | 3.95 | 53 | 6 | 42 | 36.71 | 42.55 | $2.1 \times 10^8$ | 107 |
| Example 11 | 1.59 | 3.90 | 54 | 6 | 42 | 36.54 | 26.37 | $2.5 \times 10^7$ | 113 |

TABLE 7-continued

| | Values of properties | | | | | | | | |
|---|---|---|---|---|---|---|---|---|---|
| | | | Magnetic properties after resin filling (B—H, 3 kOe) | | | Volume average | | Resistance | |
| | Apparent density ($g/cm^3$) | True density ($g/cm^3$) | Saturation magnetization ($Am^2/kg$) | Remanent magnetization ($Am^2/kg$) | Coercive force (A/m) | particle size (μm) | Charge amount (μc/g) | (250 V, 6.5-mm Gap) (Ω) | SF-1 |
| Example 12 | 2.14 | 4.08 | 69 | 5 | 30 | 37.09 | 25.92 | $9.5 \times 10^6$ | 114 |
| Example 13 | 1.44 | 3.74 | 60 | 7 | 42 | 37.24 | 47.65 | $6.5 \times 10^8$ | 107 |
| Example 14 | 1.72 | 3.82 | 68 | 6 | 36 | 38.01 | 75.13 | $1.5 \times 10^{11}$ | 119 |
| Example 15 | 1.79 | 3.94 | 58 | 7 | 42 | 37.94 | 39.76 | $2.4 \times 10^8$ | 106 |
| Example 16 | 1.7 | 3.95 | 46 | 7 | 48 | 36.98 | 31.83 | $7.5 \times 10^7$ | 109 |
| Example 17 | 2.18 | 4.10 | 72 | 5 | 30 | 37.52 | 26.18 | $6.5 \times 10^6$ | 115 |
| Example 18 | 1.79 | 3.97 | 70 | 5 | 30 | 37.39 | 44.61 | $3.8 \times 10^8$ | 106 |
| Example 19 | 1.76 | 4.00 | 56 | 6 | 42 | 37.81 | 43.51 | $4.5 \times 10^8$ | 106 |
| Example 20 | 1.74 | 3.95 | 58 | 6 | 36 | 37.16 | 38.99 | $5.1 \times 10^8$ | 105 |
| Example 21 | 1.72 | 3.97 | 38 | 7 | 48 | 36.88 | 34.31 | $6.8 \times 10^7$ | 110 |
| Comparative Example 1 | 1.38 | 3.83 | 33 | 6 | 46 | 36.92 | 50.25 | $9.5 \times 10^8$ | 107 |
| Comparative Example 2 | 1.39 | 3.95 | 73 | 8 | 66 | 37.1 | 27.91 | Not measurable | 116 |
| Comparative Example 3 | 2.1 | 4.11 | 36 | 6 | 54 | 37.29 | 26.23 | $1.8 \times 10^7$ | 118 |
| Comparative Example 4 | Carrier particles vigorously aggregated with each other, and hence no evaluation was possible. | | | | | | | | |
| Comparative Example 5 | 1.1 | 3.80 | 31 | 7 | 42 | 37.19 | 40.28 | $8.8 \times 10^6$ | 115 |
| Comparative Example 6 | 1.36 | 3.94 | 59 | 13 | 102 | 37.51 | 26.61 | Not measurable | 116 |
| Comparative Example 7 | Carrier particles vigorously aggregated with each other, and hence no evaluation was possible. | | | | | | | | |
| Comparative Example 8 | 1.16 | 3.75 | 66 | 6 | 46 | 38.1 | 15.83 | Not measurable | 132 |
| Comparative Example 9 | 2.25 | 3.97 | 33 | 8 | 90 | 37.59 | 47.19 | $8.5 \times 10^8$ | 108 |
| Comparative Example 10 | 1.1 | 3.76 | 34 | 9 | 96 | 36.69 | 33.31 | $7.2 \times 10^7$ | 111 |
| Comparative Example 11 | 1.81 | 3.95 | 22 | 16 | 126 | 37.17 | 49.12 | $6.9 \times 10^8$ | 107 |
| Comparative Example 12 | 1.82 | 3.96 | 16 | 15 | 114 | 37.33 | 44.37 | $7.2 \times 10^8$ | 106 |
| Comparative Example 13 | Carrier particles vigorously aggregated with each other, and hence no evaluation was possible. | | | | | | | | |
| Comparative Example 14 | 1.15 | 3.82 | 33 | 13 | 114 | 36.82 | 25.41 | $8.5 \times 10^6$ | 117 |
| Comparative Example 15 | 1.7 | 4.01 | 27 | 17 | 154 | 36.74 | 32.88 | $2.3 \times 10^7$ | 109 |

As is clear from the results shown in Table 7, in each of Examples 1 to 21, a resin-filled ferrite carrier having the intended properties was produced. On the other hand, in each of Comparative Examples 1, 3, 5, 9, 10, 11, 12, 14 and 15, the magnetization was too low and none of the products of these Comparative Examples was practically usable as a resin-filled ferrite carrier. In Comparative Example 2, the apparent density was low, and additionally the magnetite component was too large in amount and hence the resistance was too low; consequently, the product of Comparative Example 2 was practically inadequate as a resin-filled ferrite carrier. In Comparative Example 6, a certain saturation magnetization was attained, but on the other hand, the production amount of the Sr-ferrite was too large, the remanent magnetization and the coercive force were large, hence the fluidity was aggravated, and thus, the product of Comparative Example 6 was practically inadequate as a resin-filled ferrite carrier. In Comparative Example 8, certain magnetic properties were attained, but the resistance difference between the portion in which the core material was exposed and the portion which was filled with resin and/or the portion which was coated with the resin was extremely large, and hence the resistance was not able to be measured in a stable manner, and thus, the product of Comparative Example 8 was practically inadequate as a resin-filled ferrite carrier; further, In Comparative Example 8, the pore size was large and the mutual adhesion of the resin portions appearing on the surface of the carrier particles after the filling generated aggregated carrier particles to result in extremely poor circularity. Further, in each of Comparative Examples 4, 7 and 13, the peak pore size was too small and hence the resin filling was infeasible during the production of the carrier, thus the resin fraction made to stay on the outside of the carrier particles served as a binder to make the carrier particles vigorously aggregate with each other, and hence no resin-filled ferrite carrier was obtained. On the other hand, the resin-filled ferrite carriers obtained in Examples 1 to 21 each attained an adequate charge amount and an adequate resistance.

The porous ferrite core material for an electrophotographic developer according to the present invention does not use heavy metals, and reduces the content of Mn to be as small as possible, and hence tends to be adapted to the current environmental regulation, and attains an intended magnetization and an intended resistance while the pore volume and the peak pore size are being maintained so as to each fall in a specific range and fluidity is being ensured. Additionally the resin-filled ferrite carrier for an electrophotographic developer according to the present invention, using the porous ferrite core material, is a resin-filled ferrite carrier, hence achieves weight reduction, is excellent in durability and permits attaining a long operating life, is small in the amount of aggregated particles, and permits easy controlling of the charge amount and the resistance. Further, the resin-filled ferrite carrier for an electrophotographic developer according to the present invention is higher in strength as compared to magnetic powder-dispersed carriers, is free from the cracking, deformation and melting due to heat or impact. Thus, the electrophotographic developer using the resin-filled ferrite carrier achieves a long operation life and has a high charge amount.

Consequently, the present invention can be widely used in the fields associated with full-color machines required to be high in image quality and high-speed machines required to be satisfactory in the reliability and durability in the image maintenance.

What is claimed is:

1. A porous ferrite core material for an electrophotographic developer, wherein the porous ferrite core material comprises Mg in a content of 0.4 to 2.9% by weight of the core material, Ti in a content of 0.4 to 3% by weight of the core material and Fe in a content of 60 to 70% by weight of the core material; the porous ferrite core material has a pore volume of 0.04 to 0.16 ml/g, a peak pore size of 0.4 to 1.6 μm, a saturation magnetization of 40 to 80 $Am^2/kg$, a remanent magnetization of less than 7 $Am^2/kg$, and a coercive force of less than 43 A/m; and the porous ferrite core material comprises at least one of $MgTiO_3$ and $Mg_2TiO_4$ crystal structures.

2. The porous ferrite core material for an electrophotographic developer according to claim 1, wherein the porous ferrite core material comprises Sr in a content of 2.5% by weight or less of the core material.

3. The porous ferrite core material for an electrophotographic developer according to claim 1, wherein the porous ferrite core material has been subjected to a surface oxidation treatment.

4. The porous ferrite core material for an electrophotographic developer according to claim 1, wherein Mg content in the porous ferrite core material is 0.4 to 1.72% by weight of the core material.

5. A resin-filled ferrite carrier for an electrophotographic developer, the resin-filled ferrite carrier being produced by filling a resin in the voids of the porous ferrite core material according to claim 1.

6. The resin-filled ferrite carrier for an electrophotographic developer according to claim 5, wherein 6 to 30 parts by weight of the resin is filled in relation to 100 parts by weight of the porous ferrite core material.

7. The resin-filled ferrite carrier for an electrophotographic developer according to claim 5, wherein the resin-filled carrier has an apparent density of 1.4 to 2.5 $g/cm^3$.

8. The resin-filled ferrite carrier for an electrophotographic developer according to claim 5, wherein the resin-filled ferrite carrier has a shape factor SF-1 of less than 130.

9. The resin-filled ferrite carrier for an electrophotographic developer according to claim 5, wherein the resin-filled ferrite carrier has a bridge-type resistance of $5\times10^6$ to $1\times10^{12}$ (Ω), with a 6.5-mm gap at an applied voltage of 250 V, a saturation magnetization of 38 to 76 $Am^2/kg$, a remanent magnetization of less than 8 $Am^2/kg$ and a coercive force of less than 50 A/m.

10. The resin-filled ferrite carrier for an electrophotographic developer according to claim 5, wherein the surface of the resin-filled ferrite carrier is coated with a resin.

11. An electrophotographic developer comprising a resin-filled ferrite carrier material, produced by filling a resin in the voids of a porous ferrite core material, and a toner, wherein the porous ferrite core material comprises Mg in a content of 0.4 to 2.9% by weight of the core material, Ti in a content of 0.4 to 3% by weight of the core material, and Fe in a content of 60 to 70% by weight of the core material;

the porous ferrite core material has a pore volume of 0.04 to 0.16 ml/g, a peak pore size of 0.4 to 1.6 μm, a saturation magnetization of 40 to 80 $Am^2/kg$, a remanent magnetization of less than 7 $Am^2/kg$, and a coercive force of less than 43 A/m;

and the porous ferrite core material comprises at least one of $MgTiO_3$ and $Mg_2TiO_4$ crystal structures.

12. The electrophotographic developer according to claim 11, to be used as a refill developer.

* * * * *